US012098496B2

(12) United States Patent
McGrane et al.

(10) Patent No.: US 12,098,496 B2
(45) Date of Patent: Sep. 24, 2024

(54) EMBEDDED TEMPERATURE SENSORS FOR MONITORING TEMPERATURE OF ARTICLES AND STATUS OF DRYING OR CLEANING CYCLES

(71) Applicant: Ecolab USA Inc., St. Paul, MN (US)

(72) Inventors: Peter J. McGrane, Minneapolis, MN (US); Kyle D. Wood, Rosemount, MN (US); Kaustav Ghosh, Woodbury, MN (US); Bruce W. White, Hugo, MN (US)

(73) Assignee: Ecolab USA Inc., St. Paul, MN (US)

( * ) Notice: Subject to any disclaimer, the term of this patent is extended or adjusted under 35 U.S.C. 154(b) by 693 days.

(21) Appl. No.: 17/339,417

(22) Filed: Jun. 4, 2021

(65) Prior Publication Data

US 2021/0395941 A1 Dec. 23, 2021

Related U.S. Application Data

(60) Provisional application No. 63/041,295, filed on Jun. 19, 2020.

(51) Int. Cl.
*D06F 58/30* (2020.01)
*D06F 58/38* (2020.01)
(Continued)

(52) U.S. Cl.
CPC ..... *D06F 58/30* (2020.02); *D06F 58/38* (2020.02); *D06F 2103/12* (2020.02); *D06F 2103/38* (2020.02)

(58) Field of Classification Search
CPC ..... D06F 58/30; D06F 58/38; D06F 2103/38
(Continued)

(56) References Cited

U.S. PATENT DOCUMENTS 2,717,455 A 9/1955 Harris et al.
3,510,957 A 5/1970 Jarvis
(Continued)

FOREIGN PATENT DOCUMENTS

CN 112020388 B * 10/2023 ..... B01D 53/0454
DE 19611324 A1 10/1996
(Continued)

OTHER PUBLICATIONS

International Search Report and Written Opinion of International Application No. PCT/US2021/035934, mailed Sep. 22, 2021, 20 pp.
(Continued)

*Primary Examiner* — Stephen M Gravini
(74) *Attorney, Agent, or Firm* — Shumaker & Sieffert, P.A.

(57) ABSTRACT

An embedded temperature sensor may be attached to or otherwise associated with a textile in order to measure one or more temperatures of the textile. Temperature information received from one or more embedded temperature sensor(s) throughout the course of a dryer cycle may be analyzed to determine dryness of one or more textiles in a dryer, determine whether one or more textiles in the dryer are overdry, generate an indication of the dryness of the one or more textiles in the dryer, and/or to control one or more dryer cycles of the dryer, such as by automatically turning-off the dryer when one or more of the textiles in the dryer are determined to be dry. The embedded temperature sensor may further be used to validate a cleaning process in a cleaning machine.

24 Claims, 11 Drawing Sheets

(51) Int. Cl.
*D06F 103/12* (2020.01)
*D06F 103/38* (2020.01)

(58) Field of Classification Search
USPC ..... 34/491, 595–610
See application file for complete search history.

(56) References Cited

U.S. PATENT DOCUMENTS

| | | | | |
|---|---|---|---|---|
| 3,870,145 | A | 3/1975 | Mizuno | |
| 4,019,259 | A | 4/1977 | Veraart | |
| 4,231,166 | A | 11/1980 | McMillan | |
| 4,385,452 | A | 5/1983 | Deschaaf et al. | |
| 4,412,389 | A * | 11/1983 | Kruger | D06F 58/38 34/535 |
| 4,481,786 | A | 11/1984 | Bashark | |
| 4,549,362 | A | 10/1985 | Haried | |
| 4,763,425 | A | 8/1988 | Grennan | |
| 4,827,627 | A | 5/1989 | Cardoso | |
| 5,050,313 | A | 9/1991 | Wakaeya et al. | |
| 5,166,592 | A | 11/1992 | Bashark | |
| 5,193,292 | A | 3/1993 | Hart et al. | |
| 5,281,956 | A | 1/1994 | Bashark | |
| 5,347,727 | A | 9/1994 | Kim | |
| 5,412,291 | A | 5/1995 | Payne et al. | |
| 5,560,124 | A | 10/1996 | Hart et al. | |
| 5,570,520 | A * | 11/1996 | Huffington | F26B 25/22 34/535 |
| 5,649,372 | A | 7/1997 | Souza | |
| 5,675,911 | A | 10/1997 | Moser | |
| 5,682,684 | A | 11/1997 | Wentzlaff et al. | |
| 5,852,881 | A | 12/1998 | Kuroda et al. | |
| 5,899,005 | A | 5/1999 | Chen et al. | |
| 6,061,668 | A | 5/2000 | Sharrow | |
| 6,104,987 | A | 8/2000 | Farnsworth | |
| 6,122,840 | A * | 9/2000 | Chbat | D06F 58/46 34/535 |
| 6,141,887 | A | 11/2000 | Chen et al. | |
| 6,446,357 | B2 | 9/2002 | Woerdehoff et al. | |
| 6,484,417 | B2 | 11/2002 | Tedman et al. | |
| 6,493,963 | B1 | 12/2002 | England | |
| 6,519,871 | B2 | 2/2003 | Gardner et al. | |
| 6,745,496 | B2 | 6/2004 | Cassella | |
| 6,775,923 | B2 | 8/2004 | Do | |
| 6,779,740 | B1 | 8/2004 | Lentsch et al. | |
| 6,792,694 | B2 * | 9/2004 | Lapierre | D06F 58/50 34/493 |
| 6,845,290 | B1 | 1/2005 | Wunderlin et al. | |
| 6,910,640 | B2 | 6/2005 | Griese et al. | |
| 6,931,759 | B2 | 8/2005 | Jeong et al. | |
| 6,931,760 | B2 | 8/2005 | Yang | |
| 6,968,632 | B2 | 11/2005 | Guinibert et al. | |
| 6,988,375 | B2 | 1/2006 | Bashark | |
| 7,005,618 | B2 | 2/2006 | Riddle et al. | |
| 7,313,874 | B2 | 1/2008 | Park | |
| 7,412,783 | B2 | 8/2008 | Guinibert et al. | |
| 7,478,486 | B2 | 1/2009 | Wunderlin et al. | |
| 7,526,956 | B2 | 5/2009 | Muzzolini | |
| 7,594,343 | B2 | 9/2009 | Woerdehoff et al. | |
| 7,669,350 | B2 * | 3/2010 | Yoo | D06F 58/46 68/3 R |
| 7,900,374 | B2 * | 3/2011 | Bae | D06F 58/38 34/550 |
| 7,971,371 | B2 | 7/2011 | Beaulac | |
| 7,975,400 | B2 * | 7/2011 | Dittmer | D06F 58/30 8/138 |
| 7,975,401 | B2 * | 7/2011 | Beaulac | D06F 58/38 34/554 |
| 8,782,922 | B2 | 7/2014 | May et al. | |
| 9,206,543 | B2 | 12/2015 | Morin et al. | |
| 9,657,433 | B2 * | 5/2017 | Doh | D06F 58/50 |
| 9,739,007 | B2 | 8/2017 | Morin et al. | |
| 9,745,689 | B2 | 8/2017 | Morin et al. | |
| 9,850,621 | B2 | 12/2017 | Morin et al. | |
| 2002/0000049 | A1 | 1/2002 | Woerdehoff et al. | |
| 2002/0174564 | A1 | 11/2002 | England | |
| 2003/0034443 | A1 | 2/2003 | Kouznetsov et al. | |
| 2003/0195130 | A1 | 10/2003 | Lentsch et al. | |
| 2004/0123486 | A1 | 7/2004 | Hameed et al. | |
| 2004/0168343 | A1 | 9/2004 | Park | |
| 2005/0066999 | A1 | 3/2005 | Dietz et al. | |
| 2005/0091875 | A1 | 5/2005 | Kim | |
| 2005/0091876 | A1 | 5/2005 | Yang | |
| 2005/0183209 | A1 | 8/2005 | Costa et al. | |
| 2006/0191161 | A1 | 8/2006 | Wunderlin et al. | |
| 2007/0256321 | A1 | 11/2007 | Bae et al. | |
| 2008/0072448 | A1 | 3/2008 | Hubig et al. | |
| 2008/0104860 | A1 | 5/2008 | Muenzner et al. | |
| 2008/0184588 | A1 | 8/2008 | Somod et al. | |
| 2008/0264111 | A1 | 10/2008 | Giordani | |
| 2009/0126220 | A1 | 5/2009 | Nawrot et al. | |
| 2020/0002874 | A1 | 1/2020 | Kessler et al. | |
| 2021/0277566 | A1 | 9/2021 | Kessler et al. | |
| 2021/0395941 | A1 * | 12/2021 | McGrane | D06F 58/30 |
| 2023/0134144 | A1 * | 5/2023 | Scheckelhoff | D06F 34/05 68/12.02 |
| 2024/0133099 | A1 * | 4/2024 | Reeves | D06F 34/06 |

FOREIGN PATENT DOCUMENTS

| | | | | |
|---|---|---|---|---|
| DE | 19611324 | C2 | 2/1999 | |
| DE | 102009023228 | A1 | 12/2010 | |
| DE | 102016212980 | A1 | 1/2018 | |
| DE | 102016225823 | A1 | 6/2018 | |
| EP | 0709516 | A1 | 5/1996 | |
| EP | 0709516 | B1 | 5/1996 | |
| EP | 0816551 | A2 | 1/1998 | |
| EP | 0863244 | A2 | 9/1998 | |
| EP | 3315654 | A1 | 5/2018 | |
| JP | 4039000 | A | 2/1992 | |
| JP | 4109999 | A | 4/1992 | |
| JP | 4285599 | A | 10/1992 | |
| JP | 5115688 | A | 5/1993 | |
| JP | 10043498 | | 2/1998 | |
| JP | 10197152 | A | 7/1998 | |
| JP | 11235499 | A | 8/1999 | |
| JP | 2001194067 | A | 7/2001 | |
| JP | 2004321766 | A | 11/2004 | |
| JP | 2008194153 | A | 8/2008 | |
| KR | 19950018837 | A | 7/1995 | |
| KR | 20020076590 | A | 10/2002 | |
| KR | 20040110812 | A | 12/2004 | |
| KR | 20050118484 | A | 12/2005 | |
| KR | 100962315 | B1 | 6/2010 | |
| WO | 2008049534 | A1 | 5/2008 | |
| WO | 2018202546 | A1 | 11/2018 | |
| WO | WO-2019162949 | A1 * | 8/2019 | B01D 53/0454 |
| WO | WO-2021257297 | A1 * | 12/2021 | D06F 34/18 |

OTHER PUBLICATIONS

Genskow et al., "Psychrometry, Evaporative Cooling, and Solids Drying," Perry's Chemical Engineers' Handbook, Eighth Edition, Section 12, Oct. 26, 2007, pp. 12-1, 12-5, 12-14.

Karmakar et al., "Novel Feature for Quantifying Temporal Variability of Poincare Plot: A Case Study," Biomed Eng Online, Aug. 13, 2009, 4 pp.

Koebbe et al., "Use of Recurrence Plots in the Analysis of Time-Series Data," University of California—Santa Cruz; Rush—Pres.—St. Luke's Medical Center, Chicago, IL Sep. 29, 1994, 7 pp.

Prosecution History from U.S. Appl. No. 12/954,006, dated Aug. 16, 2013 through Mar. 13, 2014, 26 pp.

Prosecution History from U.S. Appl. No. 13/273,805, dated Oct. 8, 2014 through Nov. 5, 2015, 51 pp.

Prosecution History from U.S. Appl. No. 14/936,207, dated Jan. 6, 2017 through Jul. 26, 2017, 43 pp.

Prosecution History from U.S. Appl. No. 14/936,231, dated Jan. 6, 2017 through Jul. 24, 2017, 18 pp.

Prosecution History from U.S. Appl. No. 14/936,264, dated Jan. 9, 2017 through Nov. 11, 2017, 41 pp.

(56) References Cited

OTHER PUBLICATIONS

Response to Communication Pursuant to Rules 161(1) and 162 EPC dated Jan. 31, 2023, from counterpart European Application No. 21736436.3, filed Aug. 10, 2023, 20 pp.

* cited by examiner

EMBEDDED TEMPERATURE SENSORS FOR MONITORING TEMPERATURE OF ARTICLES AND STATUS OF DRYING OR CLEANING CYCLES

This application claims the benefit of U.S. Provisional Application No. 63/041,295, titled, "EMBEDDED TEMPERATURE SENSORS FOR MONITORING TEMPERATURE OF ARTICLES AND STATUS OF DRYING OR CLEANING CYCLES", filed Jun. 19, 2020, the entire content of which is incorporated herein by reference.

BACKGROUND

Institutional laundry settings, such as hotels, hospitals, or other commercial laundry establishments, may include tens or even hundreds of clothes dryers. It is often difficult to accurately estimate the length of time required to reach a desired final moisture level, or "dryness," for every type of textile. The size and efficiency of the dryer, the variability of the temperature and humidity of the air intake, the type and amount of textiles to be dried, the residual moisture content of the textile going to the dryer, and other factors may affect the length of the drying cycle and the dry endpoint. If the cycle length is too short, the textiles will not be fully dry at the end of the cycle, and the operator must initiate another dryer cycle to finish the drying process. If, on the other hand, the cycle length is too long, the textiles may become "overdry." In institutional settings, operators often set the dryer temperature to medium or high, and select a relatively long drying time to ensure that the textiles in the dryer will be completely dry when the cycle is completed. As a result, textiles are often overdried. Overdrying may result in premature textile degradation leading to early textile replacement, reduced efficiency of the laundry facility, excess energy consumption, and increased cost.

SUMMARY

In general, in some examples, the disclosure is related to an embedded temperature sensor that measures one or more temperatures of an article, and systems and methods for using information received from such embedded temperature sensor(s) to determine dryness of articles in a dryer. The dryer may include, for example, a clothes dryer, and the article may include a textile.

In other examples, the disclosure is related to an embedded temperature sensor that measures one or more temperatures of an article, one or more other characteristics of the article (e.g., motion, etc.), and/or one or more characteristics of a cleaning environment (e.g., conductivity, turbidity, temperature, or other characteristic of wash water in a cleaning machine, humidity in a drying chamber of a dryer, etc.), and systems and methods for using information received from such embedded temperature sensor(s) to determine dryness of articles in a dryer and/or to verify a cleaning process in a cleaning machine. The cleaning machine may include, for example, a laundry washing machine and the article may include a textile. The cleaning machine may also include a dish washing machine and the article may include any type of cooking and/or eating utensils, dishes, glassware, pots and pans, etc.

In one example, the disclosure is directed to a system comprising at least one embedded temperature sensor that senses a temperature of a textile in the drying compartment of a clothes dryer and wirelessly transmits temperature information including the sensed temperature of the textile during a dryer cycle of the clothes dryer; a computing device comprising at least one processor; and a storage device comprising instructions executable by the at least one processor to: receive the temperature information transmitted by the embedded temperature sensor; determine, based on the temperature information, a dryness of the textile at one or more times during the dryer cycle; and generate an indication of the dryness of the textile during the dryer cycle.

The storage device further may further comprise instructions executable by the at least one processor to: identify a local minima in temperature versus time data of the temperature of the textile sensed by the embedded temperature sensor at one or more times during the dryer cycle; determine that the textile is dry at a time associated with the identified local minima.

The local minima may be identified based on a first derivative test. The temperature versus time data of the temperature of the textile sensed by the embedded temperature sensor may exhibit a characteristic shape including a local maxima occurring subsequent to the start of the dryer cycle and the local minima occurring subsequent to the first local maxima. The temperature versus time data of the temperature of the textile sensed by the embedded temperature sensor may exhibit a characteristic shape including a temperature increase occurring subsequent to a start of the dryer cycle, a local maxima occurring subsequent to the temperature increase, a temperature decrease occurring subsequent to the local maxima, the local minima occurring subsequent to the first local maxima, and a second temperature increase occurring subsequent to the local minima.

The storage device may further comprise instructions executable by the at least one processor to: determine, based on the temperature information, whether the textile is overdry; and generate, upon determining that the textile is overdry, an indication that the textile is overdry. The storage device may further comprise instructions executable by the at least one processor to determine, based on the temperature information, that the textile is overdry a predetermined period of time after the textile is determined to be dry. The storage device may further comprise instructions executable by the at least one processor to automatically control the dryer cycle of the clothes dryer based on the temperature information.

Automatically controlling the dryer cycle of the clothes dryer may include generating a control signal that causes the clothes dryer to stop the dryer cycle of the clothes dryer or initiate a cool-down phase of the dryer cycle. The computing device may include a dryer controller that automatically controls the dryer cycle of the clothes dryer based on the temperature information received from the embedded temperature sensor. The computing device may include a user computing device including a user interface having a display, and the storage device may further comprise instructions executable by the at least one processor to generate, for display on the user interface, a graph of the sensed temperature information versus time received during the dryer cycle of the clothes dryer.

The computing device may include a user computing device including a user interface having a display, and the storage device may further comprise instructions executable by the at least one processor to generate, for display on the user interface, at least one of a dryer id associated with the clothes dryer, an embedded temperature id associated with the embedded temperature sensor, a textile type, a time/date stamp, a cycle number, and a battery level associated with the embedded temperature sensor.

The embedded temperature sensor may be attached to a surface of the textile and senses a surface temperature of the textile. The embedded temperature sensor may be adhered to a surface of the article. The system may further include one of a flap, tab, pocket, or envelope that is attached to the article and that is sized to receive the embedded temperature sensor in a position to sense the surface temperature of the article. The textile may form a pocket sized to receive the embedded temperature sensor in a position to sense the surface temperature of the textile.

The system may further include a plurality of embedded temperature sensors, each of which senses a temperature of an associated different one of a plurality of textiles in the drying compartment of the clothes dryer and wirelessly transmits temperature information including the sensed temperature of the associated textile during a dryer cycle of the clothes dryer. The storage device may further comprise instructions executable by the at least one processor to: receive the temperature information transmitted by each of the plurality of embedded temperature sensors; determine, at one or more times during the dryer cycle and based on the temperature information received from each of the plurality of embedded temperature sensors, a dryness of a load of laundry including the plurality of textiles present in the dryer compartment. Previous to sensing temperature of a textile in the drying compartment of a clothes dryer, the embedded temperature sensor may sense temperature of the textile during exposure to a cleaning cycle of a cleaning machine. The storage device further comprises instructions executable by the at least one processor to: receive the temperature information of the textile during exposure to the cleaning cycle of the cleaning machine transmitted by the embedded temperature sensor; determine, based on the temperature information of the textile during exposure to the cleaning cycle of the cleaning machine, whether the textile was adequately cleaning during the cleaning cycle; and generate an indication of whether the textile was adequately cleaned during the cleaning cycle.

The embedded temperature sensor may further include an inertial measurement unit that measures motion of the embedded temperature sensor during the cleaning cycle of the cleaning machine and during the dryer cycle of the clothes dryer. The embedded temperature sensor may further include at least one of a conductivity sensor or a turbidity sensor.

Previous to sensing temperature of a textile in the drying compartment of a clothes dryer, the embedded temperature sensor may sense temperature of the textile during exposure to a cleaning cycle of a cleaning machine and senses a conductivity of water in the cleaning machine during the cleaning cycle, and the storage device may further comprise instructions executable by the at least one processor to: receive conductivity information of the water in the cleaning machine during the cleaning cycle transmitted by the embedded temperature sensor; determine, based on the conductivity information, an amount of chemical cleaning product in the water during the cleaning cycle. The storage device may further comprise instructions executable by the at least one processor to verify whether the textile was adequately cleaned during the cleaning cycle based on the conductivity information.

The embedded temperature sensor may be battery powered or non-battery powered. The embedded temperature sensor may be powered by one of a super capacitor, a thermal energy harvester, or a mechanical energy harvester.

The computing device may include a cloud-based computing device located remotely from the clothes dryer. The computing device may include a local computing device and wherein the system further comprises a cloud-based computing device located remotely from the local computing device and the clothes dryer, and wherein the cloud-based computing device is configured to: receive the temperature information transmitted by each of a plurality of embedded temperature sensors during a plurality of dryer cycles executed by one or more clothes dryers; and generate one or more reports concerning analysis of the temperature information received from one or more of the plurality of embedded temperature sensors; and transmit at least one of the one or more reports to the local computing device.

The storage device may further comprise instructions executable by the at least one processor to determine that the textile is dry at a time subsequent to the start of the dryer cycle when a slope of the temperature versus time data satisfies a predetermined threshold slope. The determination that the textile is dry may be determined when the time elapsed since the start of the dryer cycle is greater than a predetermined minimum time and the first derivative of the temperature versus time data is greater than a predetermined minimum value. The predetermined minimum time may be between 10 and 30 minutes, and wherein the predetermined minimum derivative value may be between 100 and 200.

In another example, the disclosure is directed to a system comprising at least one embedded temperature sensor that senses a temperature of a textile in the cleaning compartment of a cleaning machine and wirelessly transmits temperature information including the sensed temperature of the textile during a cleaning cycle of the cleaning machine; a computing device comprising at least one processor; and a storage device comprising instructions executable by the at least one processor to: receive the temperature information transmitted by the embedded temperature sensor; determine, based on the temperature information, whether the textile was adequately cleaned during the cleaning cycle; and generate an indication of the cleanliness of the textile after completion of the cleaning cycle.

The embedded temperature sensor may further sense a conductivity of water in the cleaning machine during the cleaning cycle, and the storage device may further comprise instructions executable by the at least one processor to: receive conductivity information indicative of the conductivity of the water in the cleaning machine during the cleaning cycle transmitted by the embedded temperature sensor; determine, based on the conductivity information, an amount of chemical cleaning product in the water during the cleaning cycle; determine, based on the temperature information and the conductivity information, whether the textile was adequately cleaned during the cleaning cycle; and generate an indication of the cleanliness of the textile after completion of the cleaning cycle.

In another example, the disclosure is directed to a system comprising a plurality of embedded temperature sensors, each associated with a different one of a plurality of textiles so as to sense a surface temperature of the associated one of the plurality of textiles, wherein each embedded temperature sensor senses the surface temperature of the associated one of the plurality of textiles at one or more times during a dryer cycle of a clothes dryer and wirelessly transmits temperature information including the sensed surface temperatures of the associated textile; a computing device comprising at least one processor; and a storage device comprising instructions executable by the at least one processor to: receive the temperature information transmitted by each of the plurality of embedded temperature sensors; determine, based on the temperature information received from each of the plurality of embedded temperature sensors, a dryness of a load of laundry comprised of the plurality of textiles.

The storage device may further include instructions executable by the at least one processor to generate an indication of the dryness of the load of laundry. The storage device may further include instructions executable by the at least one processor to control operation of the clothes dryer based on the determination of the dryness of the load of laundry.

In another example, the disclosure is directed to a method comprising receiving, at one or more times during a dryer cycle of a clothes dryer, temperature information from at least one embedded temperature sensor that senses a temperature of a textile present in a dryer compartment of the clothes dryer during the dryer cycle; determining, based on the temperature information, a dryness of the textile at each of the one or more times during the dryer cycle; and generating, based on a determination that the textile is dry at one of the one or more times during the dryer cycle, an indication that the textile was determined to be dry.

The method may further comprise controlling operation of the dryer cycle of the clothes dryer based on the determination of dryness of the textile at each of the one or more times during the dryer cycle.

The details of one or more examples are set forth in the accompanying drawings and the description below. Other features will be apparent from the description and drawings, and from the claims.

DETAILED DESCRIPTION

Figure 1:
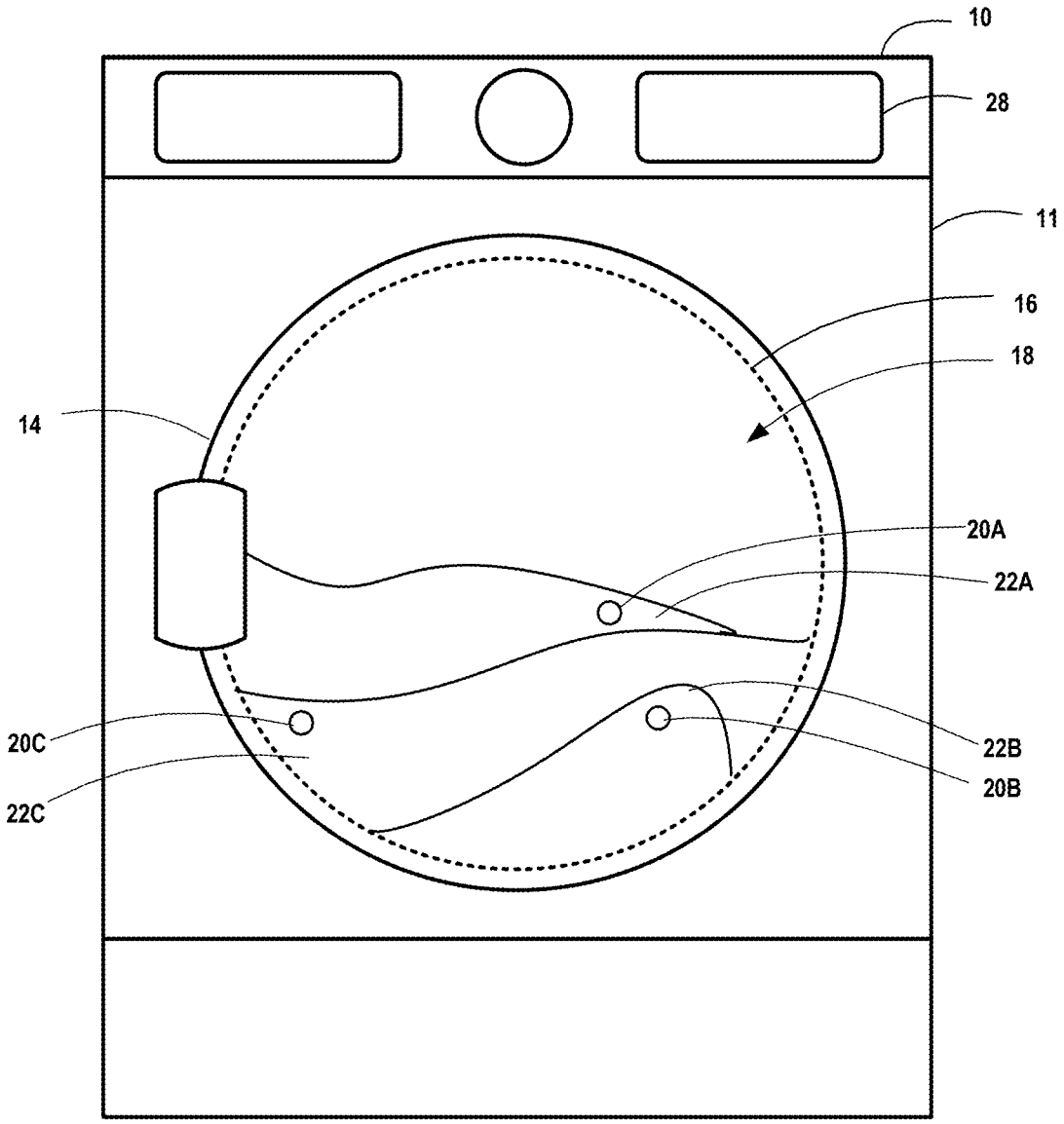
FIG. 1 is a schematic diagram showing a front view of an example clothes dryer with one or more embedded temperature sensors in the drum of the dryer in accordance with the present disclosure.

In general, the disclosure is related to an embedded temperature sensor that measures one or more temperatures of an article, such as a textile (also referred to herein as "linen") and systems and methods for using such embedded temperature sensor(s) to determine dryness of articles in a dryer. For example, temperature information from one or more embedded temperature sensor(s) throughout the course of a dryer cycle may be analyzed to determine dryness of one or more textiles in a dryer. As another example, temperature information from one or more embedded temperature sensor(s) may be analyzed to determine whether one or more textiles in the dryer are overdry. As another example, temperature information from one or more embedded temperature sensor(s) may be analyzed to generate an indication of the dryness of the textiles in the dryer. As another example, temperature information received from one or more embedded temperature sensors may further be used to control one or more dryer cycles of a dryer, such as by automatically turning-off the dryer when one or more of the textiles are determined to be dry. Examples of dryers with which the embedded temperature sensor(s) may be used include residential or commercial clothes dryers, such as those found in hotels, laundromats, uniform services, or other institutional laundry settings.

Each individual embedded temperature sensor is embedded with an article (e.g., a textile) in the sense that it is attached, affixed, adhered, secured, enclosed within, maintained in contact with, or otherwise associated with a surface of an article so as to monitor one or more temperatures associated with the article. The one or more temperatures may include one or more surface temperatures of the article. For example, the embedded temperature sensor may be directly adhered (such as by an adhesive) to a surface of the article. The embedded temperature sensor may be attached to or placed in a flap, tab, pocket, envelope, or the like that is adhered or sewn to the article. The embedded temperature sensor may be attached to the article by means of a mechanical fastener, or the sensor may be otherwise attached to or otherwise closely associated with a surface of the article. The embedded temperature sensor may be attached to the article at the time of manufacture or it may be attached at a later time. The attachment is sufficient to remain in place on the surface of the article during the course of at least one cleaning and/or dryer cycle. The attachment may be temporary (i.e., designed to be removable and/or transferable from one article to another) or permanent (i.e., not designed for easy removal or replacement, but rather designed to remain attached to the article for an extended period of time or during multiple cleaning and/or dryer cycles). Thus, it shall be understood that although the terms "embedded", "attached" or other terms may be used to describe the embedded temperature sensor and the manner in which the embedded temperature sensor is associated with or maintains contact with the article, that the disclosure is not limited in this respect. For example, the disclosure is not limited to the particular manner in which the embedded temperature sensor is associated with or maintains contact with the article, and that the disclosure envisions any type of association between the embedded temperature sensor and the article so as to measure one or more temperatures associated with the article.

The article, including the embedded temperature sensor, is laundered and then placed in the drying compartment of a clothes dryer. The article and the embedded temperature sensor are subjected to a dryer cycle in which heated air is drawn through the drying compartment, raising the temperature of the article and causing residual water in the article to be converted to steam, which is vented outside of the dryer. The embedded temperature sensor monitors the surface temperature of the article at one or more times throughout the course of the dryer cycle. The embedded temperature sensor is capable of wireless communication of the monitored temperatures. The communication of the monitored temperatures may be in real-time and/or the embedded temperature sensor may store the monitored temperatures for later download.

The temperature information may be received by one or more computing devices or controllers, which may store and analyze the temperature information to determine when the article is "dry". For example, the computing device may include a dryer controller that receives the temperature information monitored by the embedded temperature sensor and controls one or more dryer cycles based on the temperature information, such as by turning-off the dryer based on the temperature information, adjusting a length of a current dryer cycle based on the temperature information, or adjusting a length of a subsequent dryer cycle based on the temperature information. In addition or alternatively, the computing device may include a remote or user computing device, such as a smart phone, tablet computer, laptop, desktop computer that receives and analyzes temperature information monitored by the embedded temperature sensor to determine when one or more textiles in a dryer are dry. As another example, the computing device may receive and analyze temperature information from one or more embedded temperature sensor(s) to determine when one or more textiles in a dryer are overdry.

Temperature information received from a plurality of embedded temperature sensors, each attached to a different one of a plurality of articles in a load of laundry, may be used to determine when the load of laundry is "dry." For example, temperature information received from a plurality of embedded temperature sensors may be analyzed to determine that a load of laundry is "dry" when each one of the plurality of articles is determined to be dry. As another example, temperature information received from a plurality of embedded temperature sensors may be analyzed to determine that a load of laundry is "dry" when at least one of the plurality of articles, or a representative one of the plurality of articles, is determined to be dry. As another example, temperature information received from a plurality of embedded temperature sensors may be analyzed to determine that a load of laundry is "dry" when a specified percentage of the plurality of articles is determined to be dry.

Use of embedded temperature sensor(s) to measure one or more temperatures of article(s) during the course of a dryer cycle allows for more accurate determination of the dryness of the articles subjected to the dryer cycle. The temperature information may further be used to control one or more dryer cycles, such as by turning-off a dryer cycle (or by initiating a power-down or cool-down phase of a dryer cycle) when one or more of the articles in the dryer are determined to be "dry". Analysis of the temperature information from embedded temperature sensor(s) may thus lead to shorter dry times (by turning off the dryer sooner), reducing energy consumption and yielding a corresponding decrease in energy costs. Shorter dry times may also reduce wear on the articles themselves, thus extending the life of the articles and reducing the frequency at which the articles need to be replaced. In addition, with shorter dry times and faster throughput, more laundry can be processed in less time, helping to increase efficiency or the laundry facility and reduce labor costs.

Textiles (or other articles) having embedded temperature sensors may be thought of as "smart textiles", in that the embedded temperature sensors may be used to track not only temperature, but also other characteristics of the textiles. For example, information from embedded temperature sensors placed on or in articles to be laundered may be used to track when, where, how often, and under what conditions each article is laundered. For industries such as hotels, uniform services, and other institutional laundry applications, the embedded temperature sensors may be used for efficient and automated tracking and inventory management of textiles such as sheets, towels, uniforms, or any other articles that are cleaned and/or laundered, in addition to determining proof-of-clean (e.g., by validation of appropriate cleaning cycle water temperatures, validation of conductivity/detergent amounts, turbidity, cycle time, etc.) of cleaning and/or drying cycles In the description herein, examples of embedded temperature sensor(s) as used in clothes drying operations are described. However, it shall be understood that the disclosure is not limited in this respect. For example, the embedded temperature sensors described in accordance with the techniques of the present disclosure are not necessarily limited to monitoring of textiles or other linens, and may be used to monitor one or more temperatures of any type of article to be dried, and with any type of drying equipment, including clothes dryers, dishwashers, drying ovens, fans, blowers, etc. In addition, the temperature sensors in accordance with the techniques of the present disclosure are not limited to use in drying environments, but may be used to monitor one or more temperatures of any type of article that is undergoing temperature changes in a cleaning environment. The temperature sensors of the present disclosure may also be used in laundry washing machines, dishwashing machines, and any other cleaning machine where monitoring of temperature changes during the cleaning and/or drying process is desired.

FIG. 1 is a schematic diagram showing a front view of an example clothes dryer 10. Dryer 10 includes a housing 11, a control panel or user interface 28, a door 14, and a rotatable drum 16 that forms a drying compartment 18. One or more textiles 22A-22C (collectively referred to as textiles 22) to be dried are placed in the drying compartment 18. Textiles 22A-22C may be collectively referred to as a load of laundry. Each textile 22A-22C includes at least one uniquely associated embedded temperature sensor 20A-20C, respectively, (collectively referred to as embedded temperature sensors 20) attached thereto. Although three textiles 22A-22C and associated embedded temperature sensors 20A-20C are shown in FIG. 1, it shall be understood that more or fewer textiles 22 may be present in each load of laundry that is dried in drying compartment 18, and that thus more or fewer embedded temperature sensors 20 may also be present in each load of laundry to be dried.

Control panel 28 allows a user to control operation of dryer 10. Control panel 28 may include any type of dryer control, such as a start/stop control, a timed dry control, a heat level selector (e.g., high, medium, low, none) and/or a fabric-type selector (e.g., heavy duty, regular, delicate).

These controls may include mechanical controls such as one or more switches, rotatable knobs, push buttons and the like and/or may include touch pad or touch screen displays. Control panel 28 may also include one or more audible or visual indicators such as a cycle on indicator, a cool down indicator, a cycle complete indicator, an overdry indicator, an error indicator, etc. During a dryer cycle, drum 16 is rotated and heated air is blown through the drum, thus heating up textiles 22 inside dryer compartment 18. As the temperature of the textiles rises, any water within the textiles turns to steam, and the steam is carried out of the dryer through an exhaust vent. When enough of the water has been removed, the textiles may be determined to be "dry."

Each embedded temperature sensor 20 monitors at least one temperature of an associated textile 22, and this temperature information may be analyzed to determine when the associated textile is "dry." In individual homes as well as in commercial settings, such as hotels, hospitals, laundry services or other setting in which large numbers of dryers are run through multiple cycles each day, several factors may come into play in determining at what point during a dryer cycle a textile is "dry." For example, it is often the case that textiles in a dryer should be dried to the point where they are "dry" (that is, dry to the touch) but not "overdry" (that is, when the cycle continues to run past the point at which the textiles are dry to the touch, thus wasting energy and exposing the textiles to possible heat damage). To that end, temperature information from one or more embedded temperature sensors 20 may be used to determine and/or generate an indication concerning whether one or more of the associated textiles 22 within dryer 10 are "dry." In another example, temperature information from embedded temperature sensors 20 may be used to determine and/or generate an indication when one or more of the associated textiles 22 in dryer 10 are "overdry." In another example, temperature information from embedded temperature sensors 20 may be used to automatically control one or more dryer cycles of dryer 10 when one or more of the associated textiles 22 are determined to be "dry." As a result, embedded temperature sensors may help increase operational efficiency in the sense that laundry personnel are not required to periodically check each individual dryer to determine whether the textiles are dry, nor do they need to run the dryer through additional cycles in the event the dryer cycle stops before the textiles are dry. In addition, embedded temperature sensors 20 may help minimize the amount of time a dryer cycle continues to run after a dry end point has been achieved, thus reducing the likelihood that the textiles will be overdried, reducing excess energy consumption and increasing the useful life of the textiles.

Although embedded temperature sensors 20 will be shown and described herein with respect to monitoring temperatures of textiles in a clothes dryer, it shall be understood that similar temperature sensors 20 may be used with any type of object to be dried and/or drying equipment, and the disclosure is not limited in this respect. Such drying equipment may include, for example, dishwashers, ware washers, car washes, or other equipment where drying of an object or objects is required. In addition, temperature information received from temperature sensors 20 may be used to monitor and/or generate indication as to the level of dryness of an associated object in any application where such monitoring is required or desired.

Figure 2A:
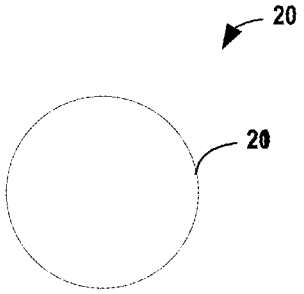
FIGS. 2A-2B are a top and a side view, respectively, of an example in-linen temperature sensor.
Figure 2B:
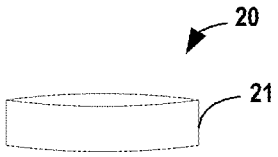

FIGS. 2A-2B are a top and side view, respectively, of an example embedded temperature sensor 20. In this example, embedded temperature sensor 20 includes a generally disc-shaped exterior housing 21 that provides a sealed water-resistant or waterproof enclosure for the sensor's internal electronic sensing, data storage and communication components. Although the housing 21 is disc-shaped in this example, it shall be understood that the housing may take any appropriate shape, and that the disclosure is not limited in this respect. In some examples, embedded temperature sensor 20 is a temperature sensor and data logger capable of real-time and/or on demand wireless communication of sensed temperature information. For example, embedded temperature sensor 20 may monitor and/or wirelessly transmit one or more sensed temperature values and/or other associated information for receipt by one or more computing device(s). The computing device(s) may include, for example, a controller associated with a clothes dryer, a mobile device (e.g., a smart phone, a tablet computing device, etc.), a laptop, desktop, or other local or remote computing device. The temperature information may further include, for each sensed temperature value, a time/date stamp, a sensor id, a cycle number, a textile type, and/or other information related to the sensed temperature information. Embedded temperature sensor 20 may also transmit device related information such as a battery level. Sensor 20 may also include an internal memory for storage of the sensed temperature values and other associated information for future retrieval or download. Embedded temperature sensor 20 may include any suitable form of wireless communication such as Bluetooth, Wi-Fi, Zigbee, near-field communication (NFC), or any other form of wireless communication.

An application running on a computing device, such as a smart phone or tablet computer, may present the temperature, device, and/or other information as one or more of data logs, text, tables, graphs, maps or other analytics associated with the monitored temperature, device or other information received from the embedded temperature sensor 20. The temperature, device and/or other information presented may be selectable and controllable by the user through the application running on the computing device.

It shall be understood that although example embedded temperature sensor 20 is generally disc-shaped, that the disclosure is not limited in this respect, and that the embedded temperature may take any suitable shape. In addition, in some examples, embedded temperature sensor may also be implemented as part of a device or accessory item that may be subjected to a cleaning/drying cycle along with articles to be cleaned and/or dried, such as a dryer ball, lint/hair catcher, dryer finishing product, etc.

Figure 3A:
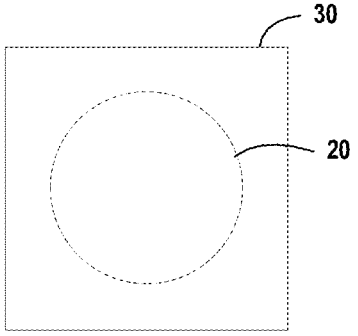
FIG. 3A-3B are a side and a perspective view, respectively, of an example embedded temperature sensor enclosed in a pocket or envelope in accordance with the present disclosure.
Figure 3B:
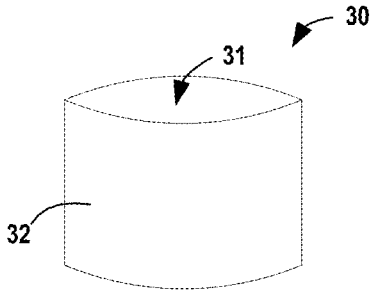

FIGS. 3A and 3B are side and perspective views, respectively, of an example carrier 30 for an embedded temperature sensor 20 in accordance with the present disclosure. In the example of FIG. 3, carrier 30 is a generally envelope-shaped article comprising one or more sides 32 forming an interior cavity 31 into which an embedded temperature sensor 20 may be placed. Carrier 30 may then be closed to prevent sensor 20 from falling out of cavity 31 during a cleaning or dryer cycle. In another example, carrier 30 may be a tab-shaped or a generally flat sheet of suitable material having at least one surface onto which an embedded temperature sensor may be adhered or otherwise attached.

Figure 4:
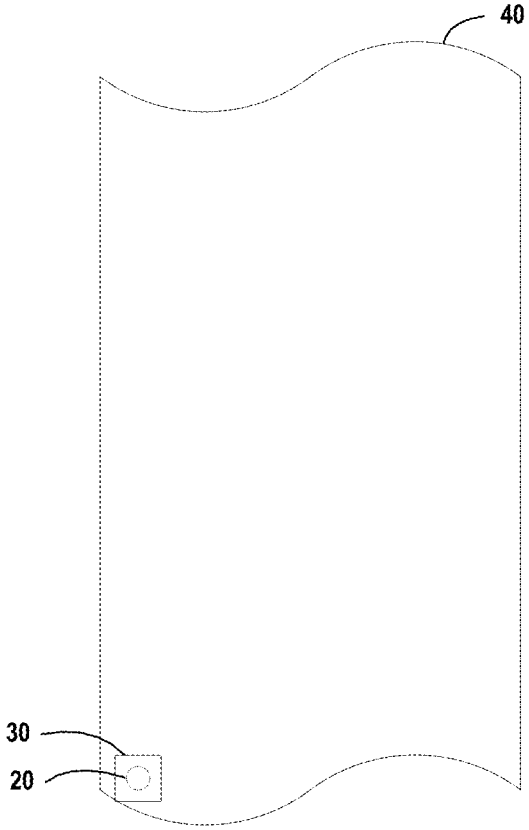
FIG. 4 is a diagram of an example textile, such as a towel or a bed sheet, including an embedded temperature sensor in accordance with the present disclosure.

FIG. 4 is a diagram of an example textile 40 including an embedded temperature sensor 20 attached thereto in accordance with the present disclosure. In some examples, as shown in FIG. 4, embedded temperature sensor 20 is attached to textile 40 indirectly by means of a carrier 30. Carrier 30 is adhered, sewn, or otherwise attached to textile 40 such that embedded temperature sensor 20 may sense one or more temperatures of textile 40. In other examples, embedded temperature sensor 20 may be attached directly to textile 40, such as by a suitable adhesive or other means of attachment. In other examples, carrier 30 may be sewn into or otherwise formed as part of the textile 40 itself. It shall be understood that embedded temperature sensor 20 may be attached to or otherwise closely associated with a textile 40 in any suitable fashion such that one or more temperatures of textile 40 may be sensed. In general, in the example of FIG. 4, embedded temperature sensor 20 is attached to textile 40 so as to sense a surface temperature of textile 40.

Although FIG. 4 shows only one embedded temperature sensor 20 attached to/associated with textile 40, it shall be understood that each textile 40 may include more than one embedded temperature sensor 20 attached at different locations on the surface of textile 40, and that the disclosure is not limited in this respect. In this way, temperature information associated with multiple locations on the surface of a textile may be obtained, and thus the level of dryness at multiple locations on the surface of the textile may be determined.

In general, embedded temperature sensor 20 is positioned with respect to a textile 40 so as to measure at least one temperature of the textile 40. For example, embedded temperature sensor 20 may be positioned with respect to textile 40 so as to measure at least one surface temperature of textile 40. In accordance with the present disclosure, it has been determined that a surface temperature of a textile as measured over at least a portion of a dryer cycle may be indicative of the relative level of "dryness" of the textile.

Figure 5:
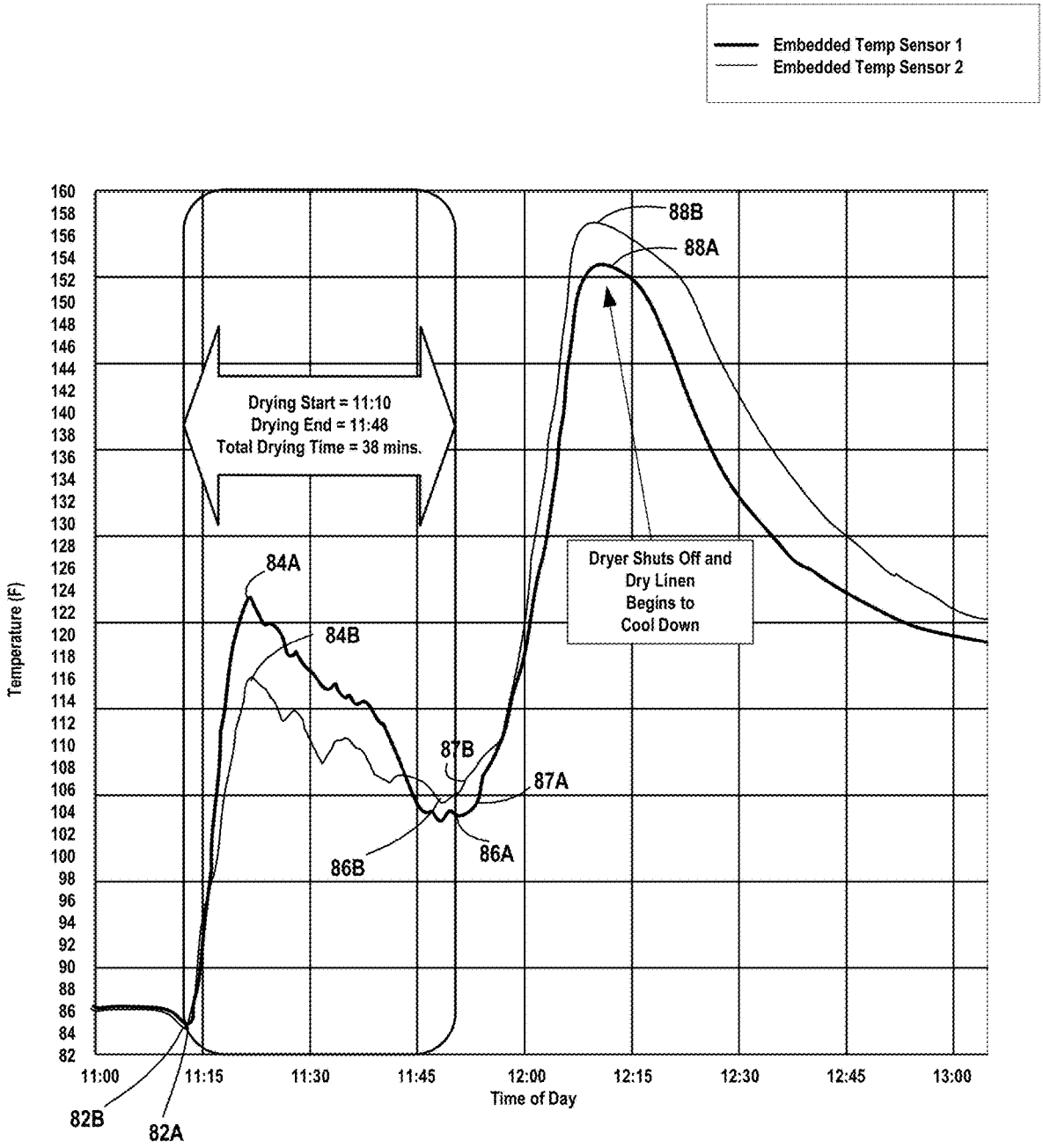
FIG. 5 is a graph showing temperature vs. time over the course of a dryer cycle for two embedded temperature sensors.

FIG. 5 is a graph showing temperature versus time over the course of an example one-hour timed dryer cycle as measured by two embedded temperature sensors, Embedded Temperature Sensor 1 and Embedded Temperature Sensor 2. Each embedded temperature sensor is associated with a different textile exposed to the same dryer cycle. As can be seen in FIG. 5, the overall shapes of the temperature/time curves are similar, and, in accordance with the present disclosure, it is this representative or characteristic shape of the temperature/time curve sensed by each embedded temperature sensor that is indicative of the dryness of the associated textile over the course of the dryer cycle.

In the example of FIG. 5, the temperature sensed by the respective embedded temperature sensors before the start of the dryer cycle (between about time 11:00 and time 11:10) was approximately 86° F. for both textiles. This is representative of the time when the textiles were removed from the washing machine and placed in the drying compartment of the dryer. At the start of the dryer cycle (at about time 11:10 as indicated by reference numerals 82A and 82B), as heated air is drawn through the dryer compartment, the textiles within the clothes dryer begin to heat up as indicated by the rise in the temperatures sensed by each of the embedded temperature sensors. In this example, the sensed temperatures for both textiles reaches a local maxima at about time 11:22 as indicated by reference numerals 84A and 84B. The sensed temperatures then begin to generally decline until about time 11:48, at which point the surfaces temperatures level off and reach a local minima as indicated by reference numerals 86A and 86B. Subsequent to time 11:48, the sensed temperatures measured by both embedded temperature sensors begin to generally rise again, reaching a second local maxima at about time 12:10 as indicated by reference numerals 88A and 88B. At this point, the one hour dryer cycle timer was complete and the dryer automatically shut off After this time, because heated air was no longer being applied within the dryer compartment, the sensed temperatures of the two textiles as measured by the embedded temperature sensors generally decrease over time as the textiles cool down.

In accordance with the present disclosure, it has been determined that a time at which the textiles may be considered to be "dry" corresponds to a time subsequent to the start of the dryer cycle when the sensed temperature of a textile being dried reaches a local minima. In the example of FIG. 5, the local minima after the start of the dryer cycle is indicated by the reference numerals 86A and 86B. The period of time from the start of the dryer cycle to the point where the textiles may be considered to be "dry" is indicated by the large arrow in FIG. 5 as the period between about time 11:10 (the start of the dryer cycle) and time 11:48 (the time of the local minima), for a total drying time of 38 minutes in this example. The period of time after the local minima (the period of time between about 11:48 and 12:10 (the end of the 60 minute dryer cycle)) during which the sensed temperatures of both textiles begins to rise again is time during which the textile may be considered to be "overdry." In other words, after about the time of the local minima, the dryer may be considered to be "overdrying" the textiles.

Thus, in accordance with the present disclosure, temperature information received from one or more embedded temperature sensor may be used to determine when one or more textiles being dried within the drying compartment of a dryer are "dry". For example, temperature information received from an embedded temperature sensor over the course of a dryer cycle may be analyzed to identify a local minima after the start of a dryer cycle, and the textile associated with the embedded temperature sensor may be determined to be dry at the time associated with the local minima.

The characteristic shape of the temperature/time curve as shown in the examples of FIG. 5 indicates that other features of the characteristic temperature/time curve may also be used to determine, or decide, when textiles are "dry." For example, rather than (or in addition to) identifying a local minima after the start of a dryer cycle, the temperature information may be analyzed to identify a time when the slope of temperature/time curve is greater than a predefined threshold. That is, the analysis may identify the second rise in temperature denoted by the curves between points 86A/86B and 88A/88B. In other words, the analysis may look for a point in time when the slope of the temperature/time curve is large enough to ensure that local minima has occurred, such as points 87A/87B, and the textile associated with the embedded temperature sensor may be determined to be dry at the time associated with the slope of the temperature/time curve is greater than a predetermined threshold. In another example, the textile may be determined to be dry a predetermined period of time after the local minima or after the slope of the temperature/time curve has been identified.

In another example, temperature information received from one or more embedded temperature sensors may be used to determine when one or more textiles being dried within the drying compartment of a dryer are "overdry". For example, temperature information received from an embedded temperature sensor over the course of a dryer cycle may be analyzed to identify a local minima, and the textile associated with the embedded temperature sensor may be determined to be overdry a predetermined period of time after the time associated with the local minima. As another example, the analysis may identify a time when a slope of the temperature/time curve is greater than a predetermined threshold, and the textile associated with the embedded temperature sensor may be determined to be overdry a predetermined period of time after the time associated with the local minima.

In another example, temperature information received from one or more embedded temperature sensors may be used to automatically control one or more dryer cycles of a clothes dryer, such as by automatically turning off a dryer cycle of the clothes dryer when one or more of the textiles being dried within the drying compartment of a dryer are determined to be "dry". In this example, temperature information received from an embedded temperature sensor over the course of a dryer cycle may be analyzed to identify a local minima, and the dryer may be automatically turned off (that is, the dryer cycle may be stopped) at the time associated with the local minima or at a predetermined time after the time associated with the local minima. As another example, instead of automatically turning off the dryer, the dryer may be automatically controlled to transition from a drying phase of the dryer cycle to a different phase of the dryer cycle, such as a cool down phase for a predetermined period of time, before automatically turning off the dryer. As another example, the dryer may be automatically turned off or transitioned to a different drying phase when the slope of the temperature/time curves reaches a predetermined threshold. As another example, the dryer may be automatically turned off or transitioned to a different drying phase at a predetermined period of time after the local minima or after the slope of the temperature/time curves reaches a predetermined threshold.

In some examples, the point in time at which the dryer is turned off or transitioned to a different dryer cycle may be customized by the user. That is, some users may prefer that the "dryness" of the textiles when the dryer is turned off is relatively more dry or relatively less dry. In such examples, a dryer controller may include a user interface that allows a user to select the relative level of "dryness" of the textiles. For example, if a user selects a relative level of dryness, "less dry", analysis of the temperature/time curve such as shown in FIG. 5 may cause the dryer to turn off as the slope of the temperature/time curve approaches the local minima. As another example, is a user selects a relative level of dryness, "more dry" analysis of the temperature/time curve such as shown in FIG. 5 may cause the dryer to turn off a predetermined period of time (adjustable depending upon the desired level of "dryness" selected by the user) after the time associated with the local minima or after the time associated with the predetermined slope of the temperature/time curve. Thus, it shall be understood that the characteristic temperature/time curve received from an embedded temperature sensor such as that shown in FIG. 5 may be analyzed in many different ways in accordance with the techniques of the present disclosure to determine and control dryness (that is, the level of dryness, such as less dry, dry, more dry, overdry, etc.) of textiles and/or to control a dryer cycle.

Figure 6:
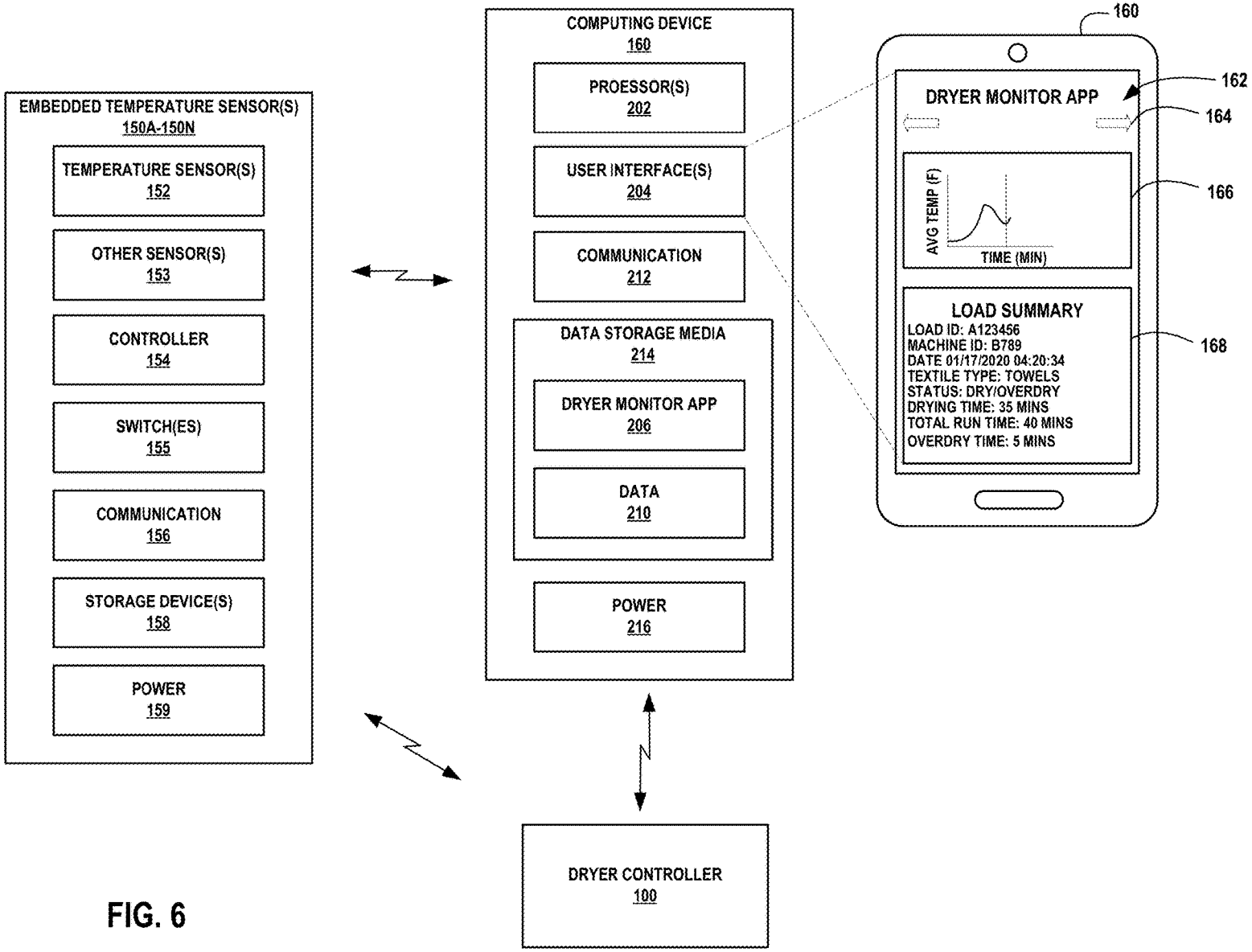
FIG. 6 is a block diagram of an example system including an embedded temperature sensor and a user computing device in accordance with the present disclosure.

FIG. 6 is a block diagram of an example embedded temperature sensor 150 in communication with a user computing device 160 and/or a dryer controller 100. Embedded temperature sensor 150 includes at least one temperature sensor 152, a controller 154, communication component(s) 156, storage component(s) 158, and a power source 159. Embedded temperature sensor 150 may also include a power on/off switch 153 and/or other user-actuated control. In some examples, embedded temperature sensor 150 may go into a "sleep" mode to conserve battery power, and enter a "wake" mode upon actuation of a switch by a user, or automatically by detection of a wake-up event, such as sensed information indicative that sensor 150 is being exposed to a laundry process, drying process, or other process to be monitored.

Embedded temperature sensor 150 may also include one or more other sensors 162. Sensors 162 may include, for example, one or more of a humidity sensor, a moisture content sensor, a conductivity sensor, a pH sensor, one or more motion sensors such as a gyroscope or accelerometer, or other sensor capable of measuring a parameter indicative of dryness of an article, or of other washing and/or drying process performance parameter(s). The electronic components of embedded temperature sensor 150 may be enclosed in a water-resistant or waterproof enclosure, such as that shown with respect to embedded temperature sensor 20 in FIGS. 2A and 2B.

Embedded temperature sensor may be powered by any suitable power source. In some examples, power source 159 may include one or more batteries, such button or coin-cell batteries. The batteries may be rechargeable by any suitable battery charging method or they may be non-rechargeable. In non-battery operated examples, power source 159 may include any suitable type of battery-free power source, such as super-capacitors, thermal energy harvesters, mechanical energy harvesters, etc. It shall be understood therefore, that the manner in which embedded temperature sensor 150 is not limited in this disclosure.

In this example, controller 154 manages capture and storage of temperature information and/or other information sensed by embedded temperature sensor 150. Controller also manages communication of the sensed information via communication component(s) 156. The communication may occur in real-time, periodically on a scheduled basis, or on demand. Communication of the sensed temperature and/or other information may occur with one or more user computing devices 160. Computing device 160 may include, for example, any one or more of a mobile computing device, a smart phone, a tablet computer, a laptop computer, a desktop computer, a server computer, a personal digital assistant (PDA), a portable gaming device, a portable media player, an e-book reader, a wearable computing device, a smartwatch, or any other type of computing device.

Communication component(s) 156 may also provide for communication with a dryer controller 100 such that the dryer controller may control operations of the dryer (such as by automatically turning the dryer off or adjusting one or more parameter(s) associated with one or more dryer cycles of the dryer) based on the temperature information received from embedded temperature sensors present in the drying compartment. To that end, communication component(s) 156 may provide for short-range wireless communication with a dryer controller within a predetermined range of the embedded temperature sensor 150. This range may be defined or controlled such that a dryer controller receives temperature information from embedded temperature sensors 150 that are present within the dryer compartment of the dryer, and not those present in other dryers at the same location. The range may thus be generally determined at least in part by the size of the dryers at issue, or other range generally associated with or around the dryers being used in a particular location. Example forms of short-range wireless communication may include Bluetooth, Wi-Fi, Zigbee, near-field communication (NFC), or any other form of short-range wireless communication. In other examples, long range (LoRa) communication may also be used to provide longer range transmission of temperature information to dryer controller 100, computing device(s) 160, any type of local and/or wide area network, etc.

Temperature information, device information such as battery status, and/or other information sensed by or about embedded temperature sensor 150 may also be communicated to one or more user computing devices, such as user computing device 160. In the example of FIG. 6, user computing device 160 is a smart phone or tablet computer including a display 162. The communication may be in real-time, periodically on a scheduled basis, or on demand. An application running on computing device 160 may generate, for display on user computing device 160, the temperature information and other information received from one or more embedded temperature sensors 150. The temperature, device, and/or other information may be generated and displayed as one or more reports, such as one or more of a data log, text, tables, graphs, maps or other analytics associated with the monitored temperature, device or other information received from one or more embedded temperature sensors 150. The temperature, device and/or other information presented may be selectable and controllable by the user through the application running on the computing device 160.

In some examples, additional information about the article(s) may also be obtained and analyzed as part of the overall cleaning and/or dryer cycle monitoring process. For example, data about the articles to be cleaned and/or dried may be obtained from a so-called "smart cart" that determines or receives information concerning the type of article to be cleaned/dried (e.g., towels, sheets, uniforms, etc.), senses a weight of the one or more articles to be cleaned/dried, etc. In such examples, this information may allow the dryness determination algorithm to be tailored based on the type and/or weight of the articles to be cleaned/dried received from the smart cart.

In addition to temperature sensor(s) 152 that sense temperature information associated with an article, embedded temperature sensor 150 may include one or more other sensors 153 that may monitor various performance parameters of a laundry or drying process. These other sensors 153 may include, for example, an inertial measurement unit (IMU), such as one or more accelerometers or gyroscopes. Information from the IMU may be used to quantify the amount of mechanical action the textiles receive during a wash or dryer cycle, and this information may further be included when determining dryness of articles during the dryer cycle and/or to validate a cleaning and/or dryer process.

Sensors 153 may also include one or more concentration sensors (such as conductivity sensors) to measure the concentration of chemical products during a wash process, turbidity sensors that measure turbidity of wash and/or rinse water during a wash process, and any other sensor(s) that may measure relevant cleaning and/or drying cycle parameters. In accordance with the present disclosure, various combinations of the different types of sensed information may be used for validation of "proof of clean" by verifying that each step of a laundry process (wash and dry) was completed properly within skipping steps or shortening exposure times. Parameters that could be included in the proof of clean and that may be sensed by an embedded temperature sensor 150 may include, but are not limited to, type of wash cycle, time for each step, one or more temperature(s), mechanical action, chemistry exposure, water level, etc.

In some examples, embedded temperature sensor 150 may be implemented using a commercially available temperature sensor. Examples of commercially available temperature sensors include Tempo Disc™ IP67 Waterproof Temperature Logger, available from Blue Maestro Limited of Woodlands, Texas, or Thermocron temperature loggers, available from OnSolution Pty Ltd of Baulkham Hills, Australia. However, it shall be understood that any suitable commercially available or custom designed temperature sensor may be used, and that the disclosure is not limited in this respect.

Computing device 160 includes one or more processors 202, one or more user interface components 204, one or more communication interfaces 212, a color sensor 208, and data storage media 214. User interface components 204 may include one or more of audio interface(s), visual interface(s), and touch-based interface components, including, for example, a touch screen display, speakers, buttons, keypad, stylus, mouse, or other mechanism that allows a user to interact with a computing device. Communication interfaces 212 allow computing device 160 to communicate with one or more embedded temperature sensors 150A-150N, and/or other remote or local computing devices via wired and/or wireless connections. The wired and/or wireless communication may include communication over one or more networks, such as any type of Local or Wide Area Networks, including Wi-Fi networks, Bluetooth communication, Near Field communication, and/or the internet. Data storage media 214 includes a dryer monitor application module 206 and data storage 210. Dryer monitor application module 206 includes computer readable instructions that, when executed by the one or more processors 202, cause the one or more processors 202 to analyze temperature information and/or other information received from the one or more embedded temperature sensors 150A-150N and, among other things, determine dryness of the textiles associated with the embedded temperature sensors 150A-150N.

For example, dryer monitor application module 206 may generate, for display on a user interface 162 of a user computing device 160, a temperature versus time plot 166 of the temperature information received from one or more of the embedded temperature sensors 150A-150N. Dryer monitor application module 206 may further generate, for display on user interface 162 of user computing device 160, a load summary 168 based on temperature information received from one or more of the embedded temperature sensors 150A-150N. For example, a load summary corresponding to one dryer cycle may include a load id, a machine id, a time/date stamp, a textile type (such as towels, sheets, uniforms, etc.), a status (not dry, dry, overdry), an actual drying time (the amount of cycle time until the textiles in the dryer were determined to be dry based on the temperature information received from one or more embedded temperature sensors 150A-150N), a total cycle run time (the total time from start to finish of the dryer cycle), and an overdry time (based on the difference between the total cycle time and the actual dry time, indicative of the amount of time the dryer cycle was running past the point the textiles were dry).

Figure 7:
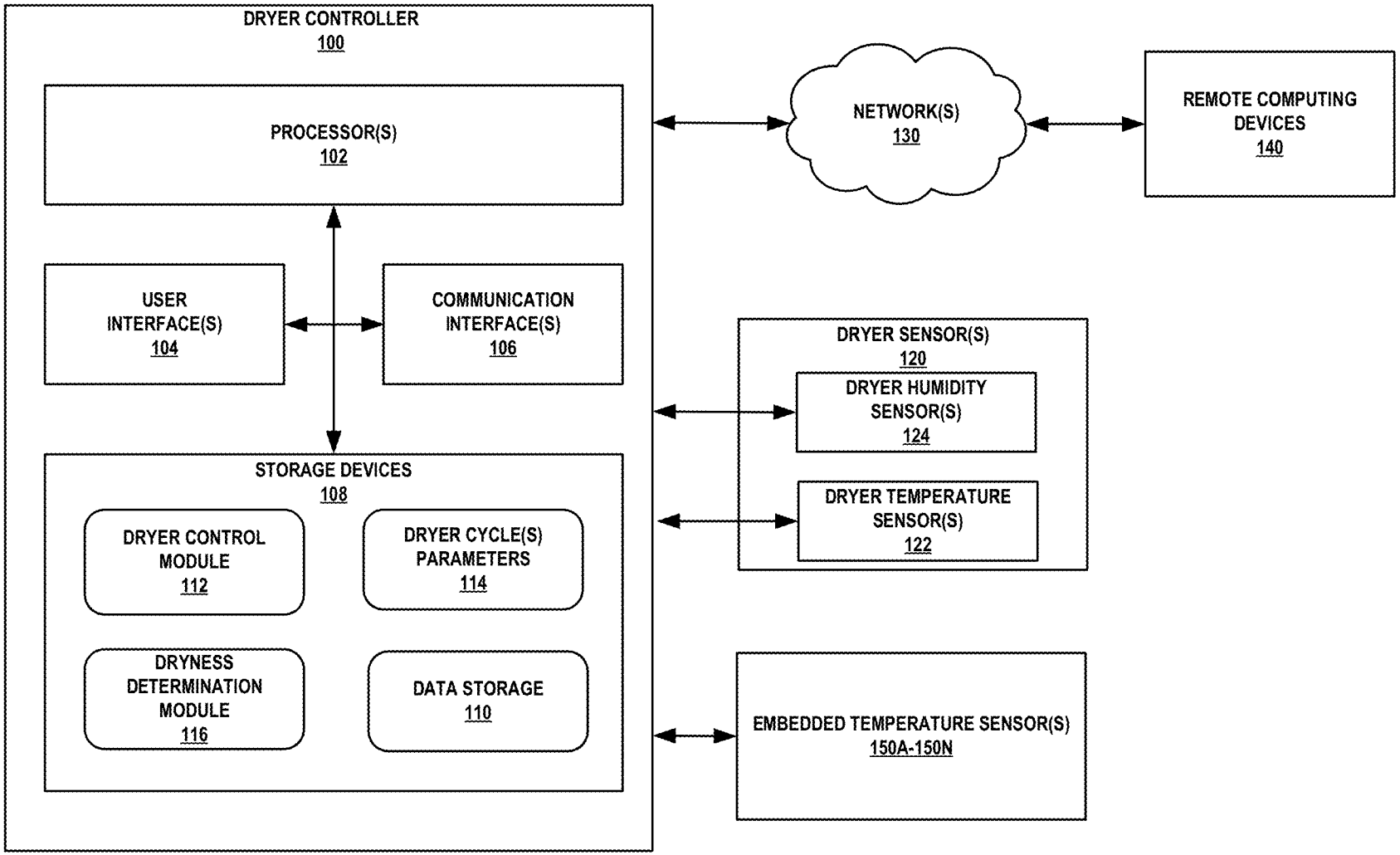
FIG. 7 is a block diagram of an example system including a dryer controller and one or more embedded temperature sensor(s) in accordance with the present disclosure.

FIG. 7 is a block diagram of the electronic components of an example dryer controller 100 in communication with one or more embedded temperature sensor(s) 150A-150N in accordance with the present disclosure. Dryer controller 100 is associated with and configured to control operations of a dryer, such as clothes dryer 10 of FIG. 1. Dryer controller 100 may communicate with one or more embedded temperature sensors 150A-150N, each of which is associated with a textile being dried in the drying compartment of an associated clothes dryer during a dryer cycle.

In this example, dryer controller 100 includes the electronic components configured to control one or more dryer cycles of an associated clothes dryer, and is further configured to communicate with one or more embedded temperature sensors, such as embedded temperature sensor 150A-150N. Dryer controller 100 includes at least one processor 102 and one or more storage device(s) 108 that store programs and/or data associated with operation of dryer controller 100. Dryer controller 100 may also include a user interface 104 through which a user may monitor and control operation of one or more dryer cycles of the dryer. Communication interface(s) 106 may provide for communication with one or more local or remote computers, smart phones, tablet computers, or other mobile devices. Communication interface(s) 106 also provide for communication with one or more embedded temperature sensor(s) 150. For example, communication interface(s) 106 may provide for wireless communication with one or more embedded temperature sensors 150A-150N within a predetermined range. This range may be such that controller 100 receives temperature information from those embedded temperature sensors 150A-150N that are located within the dryer compartment of the associated dryer, and not those from neighboring drying compartments. The range may thus be generally determined at least in part by the size of the clothes dryer, or other range generally associated with or around the clothes dryer.

During the course of a dryer cycle, dryer controller 100 receives dryer status information from one or more sensors 120 associated with the dryer, such as temperature sensor(s) 122 and/or humidity sensor(s) 124. Sensors 120 may also include moisture content sensors, dryer on/off sensors, or any other sensors that may detect relevant information concerning operation of the dryer or status conditions of the dryer. Sensors 120 may be located at any appropriate position with respect to the dryer where it is convenient or where it is best suited to measure the dryer information at issue. For example, one or more of sensors 120 may be located inside and/or outside the drying compartment of the dryer, in or near an exhaust vent or exhaust compartment, or in any other suitable location where information concerning the dryer may be useful. The sensed dryer information received from any of sensors 120 may be stored by dryer controller 100 in data storage 110.

Dryer controller 100 includes one or more storage device(s) 108 that include a dryer control module 112, a dryness determination module 116, dryer cycle parameters 114, and data storage 110. Modules 112 and 116 may include operations described using software, hardware, firmware, or a mixture of hardware, software, and firmware residing in and/or executed by dryer controller 100. Dryer controller 100 may execute dryer control module 112 and/or dryness determination module 116 using one or more processors 102. Modules 112 and 116 are shown as separate modules for purposes of illustration only, and it shall be understood that the disclosure is not limited in this respect.

Dryer control module 112 contains the software programming that, when executed by the one or more processor(s) 102 of controller 100, controls one or more dryer cycles of the dryer. Dryer cycle parameters 114 includes parameters corresponding to one or more preset dryer cycles. For example, the preset dryer cycles may include one or more of a normal cycle, a heavy duty cycle, a permanent press cycle, a delicates cycle, a sanitization cycle, or any other preset dryer cycle. The parameters associated with each preset dryer cycle may include one or more of a dryer temperature (high, medium, low, air only, etc.), a cycle duration (a specific length of time associated with the dryer cycle), and/or a dryness level (more dry, normal dry, less dry, etc.). The parameters associated with each preset dryer cycle may be further adjustable by the user, for example, if the user desires to add additional time to a preset dryer cycle to or adjust the temperature of a preset dryer cycle. The dryer cycle parameters 114 may further include dryer parameters input by the user via the user interface 104 control panel. Dryer cycle parameters 114 may further include parameters associated with one or more customized dryer cycles input by a user. Alternatively, dryer cycle parameters 114 may be configured with customized settings by a service technician at the time of installation. Customized dryer cycle parameters 114 may also be configured or downloaded remotely at some later time. For example, customized dryer cycle parameters 114 may be devised for specific accounts, geographical locations, etc., if desired.

Dryer control module 112 may also receive information from dryness determination module 116 in order to control one or more dryer cycles of the dryer.

Dryness determination module 116 contains the software programming that, when executed by one or more processor(s) 102 of a dryer controller 100, analyzes temperature information received from one or more embedded temperature sensor(s) 150A-150N to determine whether or when one or more textiles are "dry." For example, dryness determination module 116 may analyze temperature information received from one or more embedded temperature sensor(s) 150A-150N over the course of a dryer cycle to identify a local minima, and may determine that the textile(s) associated with the embedded temperature sensor(s) are "dry" at the time associated with the local minima or at a predetermined period of time after the time associated with the local minima.

In another example, dryness determination module 116 may analyze temperature information received from one or more embedded temperature sensor(s) 150A-150N to determine whether or when one or more textiles are "overdry". In this example, dryness determination module 116 may analyze the temperature information received from one or more embedded temperature sensor(s) over the course of a dryer cycle to identify a local minima, and may determine that the textile(s) associated with the embedded temperature sensor(s) are "overdry" at a predetermined period of time after the time associated with the local minima.

In another example, dryness determination module 116 may analyze temperature information received from one or more embedded temperature sensor(s) 150A-150N to automatically control one or more dryer cycles of a clothes dryer. For example, dryness determination module 116 may automatically turn off a dryer cycle of the clothes dryer when textiles being dried within the drying compartment of a dryer are determined to be "dry". In this example, dryness determination module 116 may analyze temperature information received from one or more embedded temperature sensor(s) over the course of a dryer cycle to identify a local minima, and dryness determination module 116 may cause controller 100 to automatically turn off the dryer (that is, the dryer cycle may be stopped or the dryer may be shut down or turned off) at the time associated with the local minima or at a predetermined period of time after the time associated with the local minima. As another example, instead of automatically turning off the dryer, the dryness determination module 116 may cause controller 100 to automatically control the dryer to initiate another phase of the dryer cycle, such as to transition from a heated drying phase of the dryer cycle to a cool down phase of the dryer cycle, before automatically turning off the dryer.

Dryer controller 100 may generate one or more electronic communications concerning temperature information received from one or more embedded temperature sensors 150A-150N during the course of a dryer cycle, dryness of one or more textiles in the dryer, sensed dryer information (such as temperature, humidity, and/or moisture levels in the dryer), status of the dryer or various fault conditions of the dryer. Dryer controller 100 may transmit the electronic communications for receipt by laundry personnel, a service technician, a monitoring service, or one or more users associated with the location or entity with which the dryer is associated. The communications may be transmitted either wired or wirelessly, in real-time and/or on demand. For example, the communications may be transmitted via e-mail, text message, voice mail, push notification, download, or by other means of electronic communication. The communications may be received by a user computing device and presented in an application running on the user computing device.

In the examples shown and described above, dryer controller 100 is associated with a single dryer, such as dryer 10 of FIG. 1. However, in other examples, dryer controller 100 may be associated with multiple dryers. For example, dryer controller 100 may receive temperature information from one or more embedded temperature sensors 150A-150N being dried by one or more dryers. In this way, dryer controller 100 may monitor dryer information and/or automatically control dryer cycles based on the temperature information received from one or more embedded temperature sensors 150A-150N for one or more dryers at a laundry location. Such a feature may be useful, for example, in locations with more than one dryer, such as hotels or other commercial laundry establishments.

In some examples, dryer controller 100 may also track the amount of time an associated dryer operates in the overdry state. In those applications where the dryer is not automatically turned off upon determination that the textiles are dry, the amount of time spent in overdrying may be used to determine information concerning excess energy usage and the costs associated with that excess energy usage. For example, knowing the amount of time the dryer operates in the overdry condition, and knowing certain specifications of the dryer such as average energy usage per unit time, dryer controller 100 may calculate the amount of excess energy unnecessarily expended in the overdry condition (that is, continuing to operate the dryer after the laundry is already dry). In addition, knowing the rate of utility cost per unit time, dryer controller 100 could also determine the cost of that excess energy usage. Tracking and reporting of excess energy usage and cost to management personnel may be valuable for the overall management and operation of commercial laundry establishments. Analysis of this data, either locally by dryer controller 100 or via a remote or local computing device, may be used to generate reports concerning dryer operations and/or identify changes that occur with the dryer over time. Such information may be determined and/or displayed by a local or remote computing device, such as computing device 160 of FIG. 6.

Figure 8:
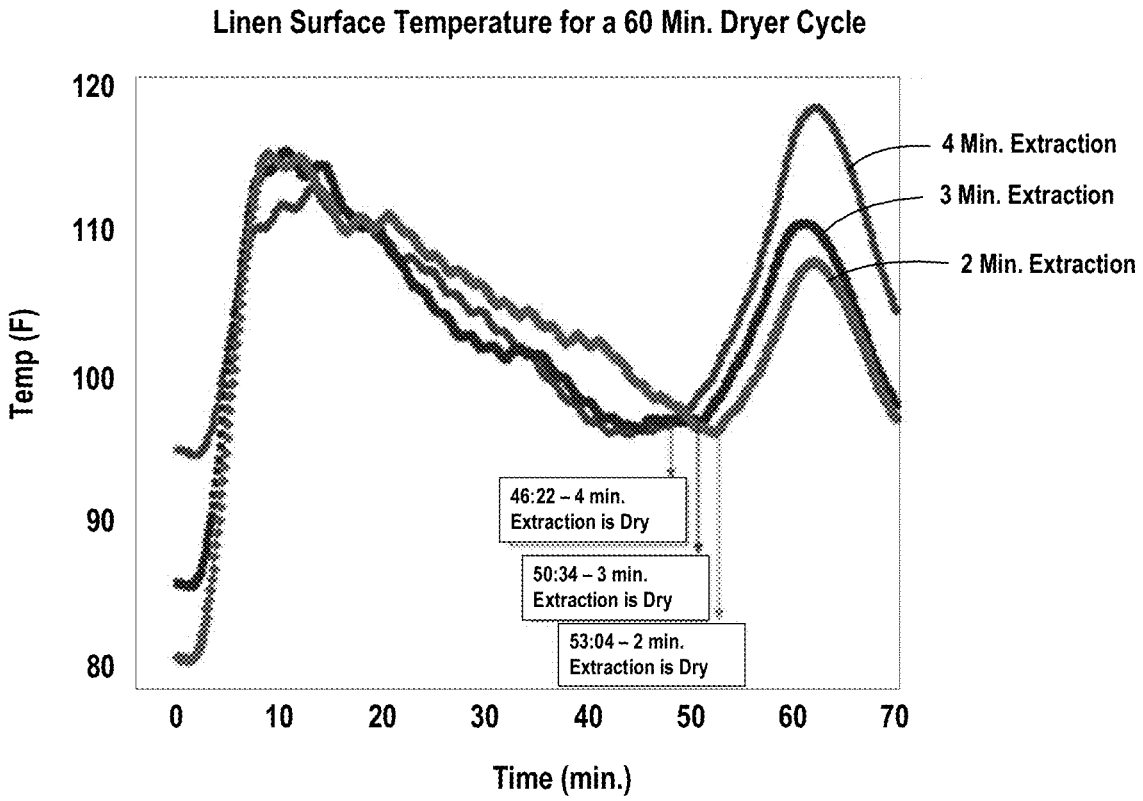
FIG. 8 is a graph showing example linen surface temperature versus time for a 60 minute dryer cycle for 3 different extraction times.

FIG. 8 is a graph showing example linen surface temperature obtained from embedded temperature sensors versus time for a 60 minute dryer cycle at three different extraction times. The three extraction times include a 4 minute extraction time, a 3 minute extraction time, and a 2 minute extraction time. The time at which the textiles were determined to be "dry" corresponds to the local minima as indicated in FIG. 8. In accordance with the present disclosure, the characteristic shape for each of the three extraction curves is indicative of the relative dryness of the associated textile. The characteristic shape includes a first increase in temperature at the beginning of the cycle, a first local maxima, a first decrease in temperature after the first local maxima, a first local minima indicative of the time that the textiles are "dry", a second increase in temperature following the first local minima (corresponding, for example, to an increase in temperature as additional heat is applied to the dry textiles in the drying compartment), a second local maxima at the time the machine shuts off at the end of the 60 minute dryer cycle, followed by a second decrease in temperature as the textiles in the dryer cool down.

Higher extraction times generally yield lower levels of residual moisture in the textiles upon entering the dryer, which generally yields faster drying times. FIG. 8 indicates that the embedded temperature sensors correctly identified a faster drying time for textiles that were subjected to longer extraction times. The textiles that experienced longer extraction times began to increase in temperature following the first local minima indicative of the "dry" point before the textiles that experienced shorter extraction times. In the examples of FIG. 8, the local minima at time 46:22 corresponds to the time that the textiles subjected to the 4 minute extraction time were dry. The local minima at time 50:34 corresponds to the time that the textiles subjected to the 3 minute extraction time were dry. The local minima at time 53:04 corresponds to the time that the textiles subjected to the 2 minute extraction time were dry. Thus, in this example, the textiles subjected to the 4 minute extraction time was dry 4:12 sooner than the 3 minute extraction time, and 6:42 earlier than the 2 minute extraction time. As extraction generally uses less energy than heated dryer cycles, this data shows that increasing the extraction time may be compensated for in terms of time by shorter durations of the dryer cycle in addition to savings in energy costs associated with a shorter dryer cycle.

Figure 9:
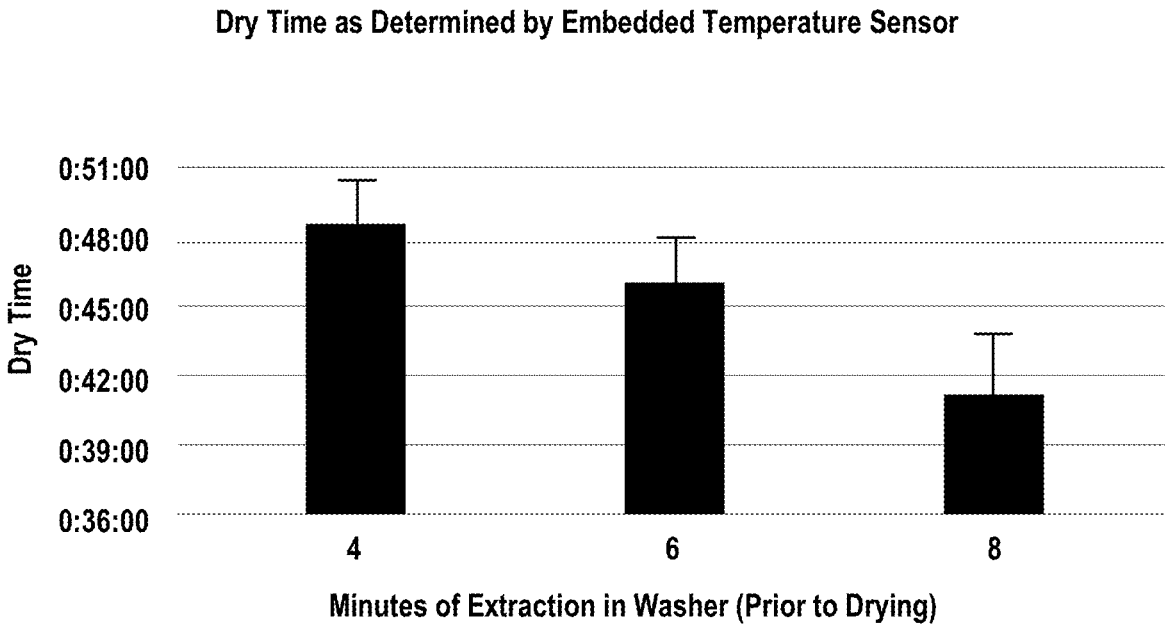
FIG. 9 is a graph showing example dry times as determined by embedded temperature sensors for 3 different extraction times.

FIG. 9 is a graph showing example dry times as determined by embedded temperature sensors for three different extraction times. The three extraction times include a 4 minute extraction time, a 6 minute extraction time, and an 8 minute extraction time. The time at which the textiles were determined to be "dry" in each case corresponds to the height of the bar at each extraction time. Once again, FIG. 9 indicates that the embedded temperature sensors correctly identified earlier "dry" times for those textiles experiencing longer extraction times. In this example, the 8 minute extraction time corresponded to the shortest "dry" time and the 4 minute extraction corresponded to the longest "dry" time.

Figure 10:
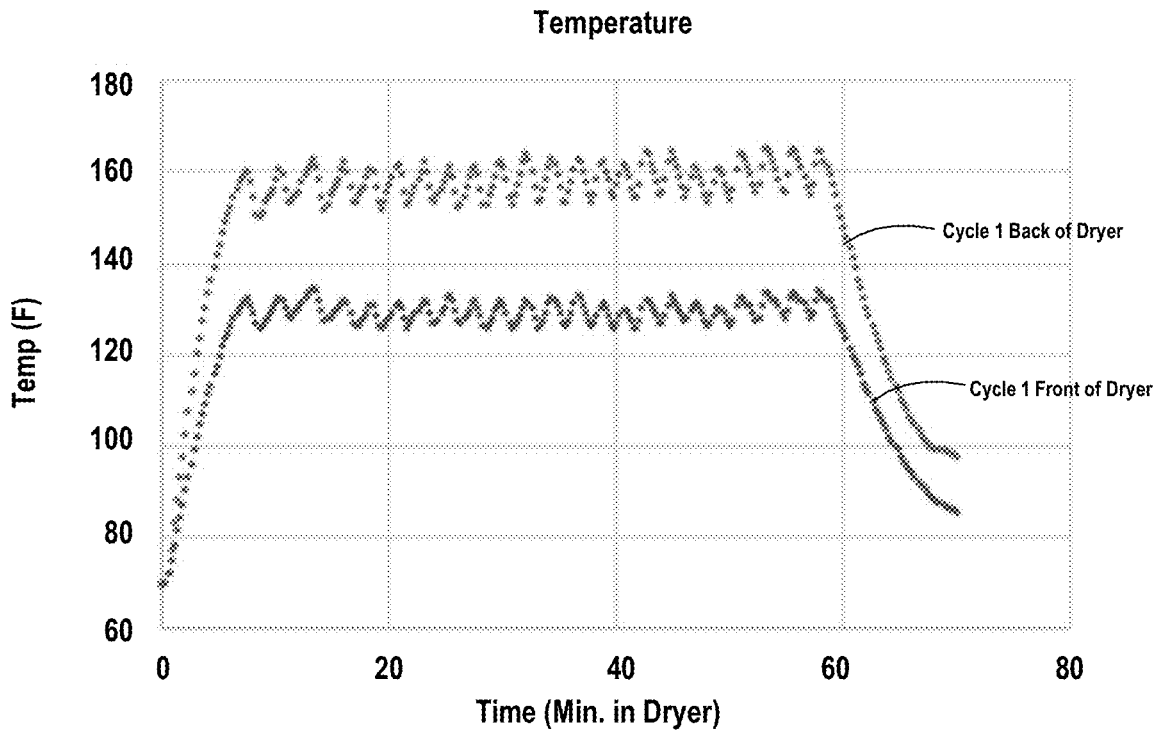
FIG. 10 shows temperature versus time data taken from the inside of a dryer at two different locations.

In accordance with the present disclosure, it has been determined that the characteristic shape of the curve illustrated in FIGS. 5 and 8, for example, is not obtained when temperatures are not sensed directly from the textiles themselves. FIG. 10 shows temperature versus time data taken from the inside of a dryer at two different locations, but not from embedded temperature sensors attached to the textiles being dried. The top curve represents temperature versus time as obtained by a temperature sensor placed along the back panel of the dryer underneath the rotating drum. The lower curve represents temperature versus time as obtained by a temperature sensor placed toward the front of the dryer also underneath the rotating drum. As can be seen in FIG. 10, there is no discernible signature other than the small temperature oscillations corresponding to the heating element being turned on and off to maintain a set temperature during the dryer cycle. With the temperature information of FIG. 10, there is no change in temperature that can help determine when the textiles subjected to the dryer cycle are dry.

Without being bound by theory, the following may explain what is happening inside a dryer compartment of a dryer during the course of a dryer cycle. The heat from the dryer converts to internal energy in both the linen and the water within the linen causing an embedded temperature sensor to measure a quick increase in temperature upon beginning the drying cycle. Water molecules at the surface of the linen undergo evaporation, at a faster rate than water molecules inside the linen, due to the increased temperature in the dryer, once they have enough internal energy to overcome the enthalpy difference between the liquid and vapor states. During the temperature rise to the local maxima the rate of evaporation of the water molecules, and therefore the resulting cooling effect on the linen, is less than the heating effect from increasing the internal energy of other water molecules and the linen. As water molecules at the surface evaporate, the average thermal energy of the linen-water system decreases causing the embedded temperature sensor to measure a leveling off and then a decrease in temperature over a period of time. This evaporation process continues until all of the water has moved from a liquid in the linen, to the surface of the linen, to a vapor in the drying compartment and removed from the dryer via the heat duct. Once there is no more water in the linen the linen is considered to be "dry." This is the approximate point of the local minima, or the predetermined slope of the increase after the local minima, in the temperature vs. time curve. The heat product from the dryer converts to internal energy in the linen causing the temperature sensor to measure an increase in temperature. This unique temperature curve can be used to classify when the linen is "dry" and help to reduce or eliminate overdrying, and may be measured by having a temperature sensor embedded within or attached to the surface of the linen in accordance with the present disclosure. In general, the phrase "embedded in the linen" means that the embedded temperature sensor is in a position to sense a temperature that is characteristic of the linen temperature. This may include both sensors that are manufactured into the linen, as well as adhered to the linen after manufacturing, and may include sensors that are made to stay in the linen in perpetuity as well as sensors that can be removed from the linen within the lifetime of the linen.

In accordance with the present disclosure, either the local minima and/or the predetermined slope of the increase after the local minima may be characterized in determining when the linen has been heated to a point where it can be considered "dry". In general, when the temperature information is being used to control a dryer cycle, the decisions made based on the information received from the embedded temperature sensors need to be made based on the temperature data in real-time (or near real-time) without future knowledge of whether an additional local minima is coming. The slope of the line after the local minima can be used to determine the probability of another local minima coming. In other words, a high enough slope (as established by a predetermined threshold slope) in the temperature/time curve may be used to establish that there is most likely no additional decrease in temperature coming during the rest of the dryer cycle.

It shall be understood that there may be multiple methods of identifying a local minimum in the temperature information sensed by an embedded temperature sensor, and that the disclosure is not limited in this respect. Examples of mathematically identifying local minima include the first derivative test, a combination of the first and the second derivative tests, and other methods. The methods may include applying smoothing or filtering function(s) to the temperature information to account for variations or noise in the temperature data.

In some examples, the analysis of the temperature/time curve may wait for a predetermined minim period of time before testing for the local minima and/or the predetermined threshold slope. For example, referring again to FIG. 5, it may be empirically determined that the local minima does not occur until at least a predetermined period of time after the start of a dryer cycle.

In one example a method of identifying a local minima in the temperature information sensed by an embedded temperature sensor using the first derivative test may be expressed as follows:

T=temperature t=time $t_{min}$=20 minutes (predetermined period of time after start of dryer cycle)

$dT/dt_{min}$=150 (predetermined threshold slope)

For a sampling rate of 1 sample/5 seconds,

If t>20 minutes in the dryer and dT/dt>150, then linen is determined to be dry.

This example method essentially computes the derivative of the temperature versus time curve at each point after a predetermined initial period of time (20 minutes in this example) and, when the derivative is greater than a specified threshold (150 in this example) the location of the local minima is identified. The initial period of time of 20 minutes in this example is used to make sure that the temperature vs. time curve is not analyzed for the local minimum until after the first local maximum has occurred. In this example, the initial period of 20 minutes was empirically determined as a time after the occurrence of the first local maxima and before the occurrence of the first local minima. This may be seen in the examples shown in FIGS. 5 and 8, in which the 20 minute mark occurs somewhere after the first local maxima and the first local minima in those examples. Similarly, the specified threshold of 150 for the first derivative may be empirically determined based on experimental data.

It shall be understood, therefore, that the particular constants used in this example (that is, the initial period of time of 20 minutes and the specified threshold of 150) may be any suitable values, and that these values may differ depending upon one or more factors, including the dryer type, the type of textiles being dried, the dryer cycle type (e.g., normal, heavy duty, delicates, etc.), the geographic location of the dryer facility, the environmental conditions within the laundry facility and/or outside the laundry facility, the chemical products used during the cleaning process, the length of the extraction cycle, and other factors. It shall be understood, therefore that the disclosure is not limited in this respect.

In accordance with the present disclosure, the location (time) of the local minimum in the temperature information sensed by an embedded temperature sensor may be defined as being indicative of the time at which the associated textile may be determined to be "dry". This point in time may also be referred to as the "dry point". In other examples, the dry point may be defined as occurring a specified time after the time associated with the local minima. For example, some customers may prefer that their linen be slightly "overdry" and as such a dry point may be defined as occurring a predetermined period of time after the local minima, such as 1 minute, 2 minutes, 3 minutes, or other defined time after the local minima.

It shall be understood that other methods of identifying the so-called first local minima in the temperature information sensed by an embedded temperature sensor corresponding to the "dry" time may be identified in many different ways, and that the disclosure is not limited in this respect. Many different methods of mathematically identifying a local minima and its associated values (time and temp in this example) may be used. In addition, any suitable method may be used to identify values of the first and/or second local maximas, as well as information (such as the slope or derivative of the curve at any point or over a plurality of points) concerning the first temperature increase, the first temperature decrease, the second temperature increase, and/or the second temperature decrease.

Figure 11:
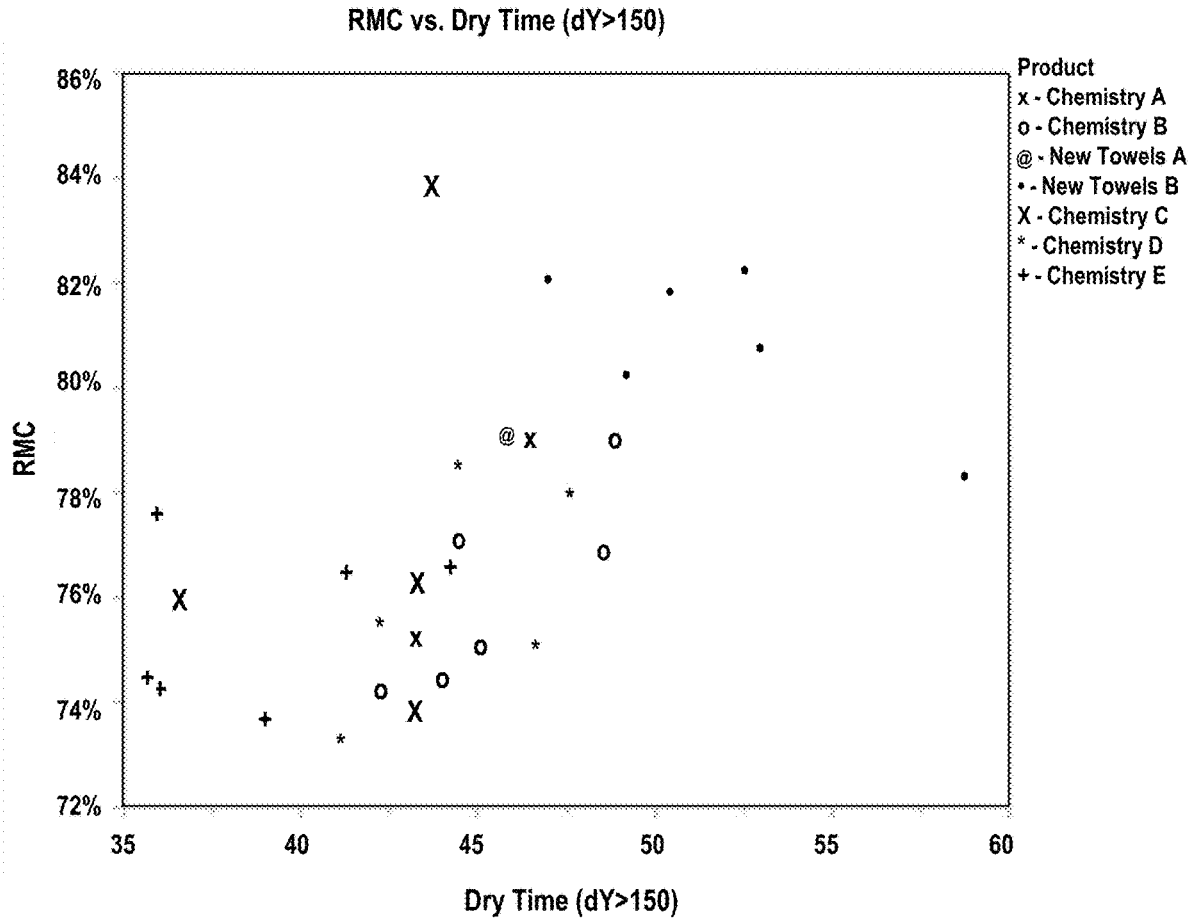
FIG. 11 is a graph of residual moisture content (RMC) versus "dry" time for several different loads of laundry.

FIG. 11 is a graph of residual moisture content (RMC) versus "dry" time (the time at which dT/dt>150) for several different loads of laundry. Each load of laundry corresponded to either different types of chemistries used in the wash process (such as those chemistries identified by Chemistry A, Chemistry B, Chemistry C, Chemistry D, and Chemistry E) or two different types of new towels (New Towels A and New Towels B) that were washed without any chemistry.

FIG. 11 illustrates that the predicted dry time as predicted from the temperature information received from embedded temperature sensors lined up well with RMC in that textiles with higher RMCs generally took longer to be determined to be "dry." Analysis of temperature information sensed by embedded temperature sensors in accordance with the disclosure is able to distinguish between different dry times experienced by different chemistries and/or different textile types.

Figure 12:
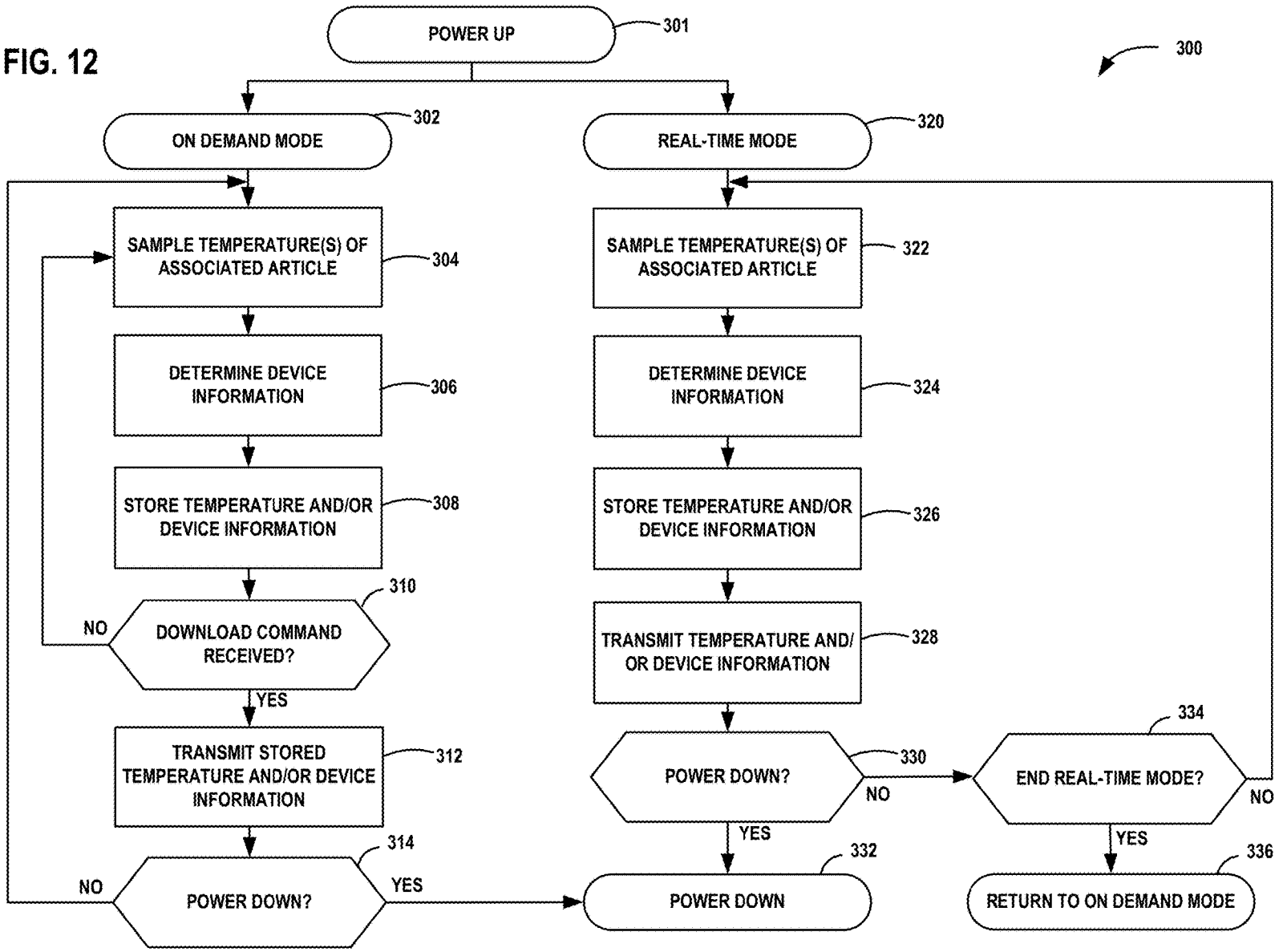
FIG. 12 is a flow chart illustrating an example process by which an embedded temperature sensor may monitor and/or transmit temperature information of an associated textile.

FIG. 12 is a flow chart illustrating an example process (300) by which an embedded temperature sensor may monitor and/or transmit temperature information of an associated textile. The temperature information received from the embedded temperature sensor may be analyzed by one or more computing devices to monitor dryness of the associated textile during a dryer cycle, to determine at what point during the dryer cycle the associated textile is "dry", and/or to determine when the associated textile is "overdry".

Upon power-up (301) the embedded temperature sensor may enter an on demand mode (302) or a real-time mode (320). The mode may be configured by a user via a dryer monitor application running on a user computing device, such as dryer monitor application 206 running on user computing device 160. The user computing device may wirelessly communicate configuration information or commands, such as the operational mode of the embedded temperature sensor (such as real-time or on demand), to the embedded temperature sensor based on input received from a user. Upon receipt of the communication, the embedded temperature sensor configures itself according to the received commands, including the operational mode, sampling rate, communication range, etc.

In on demand mode (302), the embedded temperature sensor monitors and stores the temperature of the associated textile at the specified sampling rate (304). At each sample (or at some other predetermined period of time) the embedded temperature sensor determines device information such as battery status, time of use, etc. (306). The embedded temperature stores the temperature and/or device information (308) in a data log for later retrieval or download upon request of a user, or for transmission according to a predetermined download schedule.

If a download command is received (312) the embedded temperature sensor wirelessly transmits the stored temperature and/or device information for receipt by, for example, a dryer controller or a user computing device within the transmission range of the embedded temperature sensor. If a power down command is received (314), the device powers down 332. If no power down command is received (314), the device continues to sample the temperature of the associated article (304) and store the temperature and/or device information (306, 308) until the power down command is received (314).

In another example, the embedded temperature sensor may include an internal sensor that provides information from which the power-up and/or power-down decision can be made. For example, the embedded temperature sensor may power-up based on motion received from an IMU indicative that a dryer or wash cycle has started and power-down a predetermined amount of time after no motion has been detected.

In real-time mode (320), the embedded temperature sensor samples and stores the temperature of the associated textile at the specified sampling rate (322). At each sample (or at some other predetermined period of time) the embedded temperature sensor determines device information such as battery status, time of use, etc. (324). The embedded temperature stores the temperature and/or device information (326) in a data log. The embedded temperature sensor wirelessly transmits, in real-time or near real-time, the temperature and/or device information (328). If a power down command is received at any time during real-time mode (330), embedded temperature sensor powers down (332). Otherwise, if an end real-time mode command is received (334), embedded temperature sensor will remain powered on and return to on demand mode (302). If no end real-time mode command is received (334), embedded temperature sensor continues to sample and wireless transmit temperature information of an associated textile on a real-time or near real-time (322, 324, 326, 328) until the power down or end real-time mode command is received.

Figure 13:
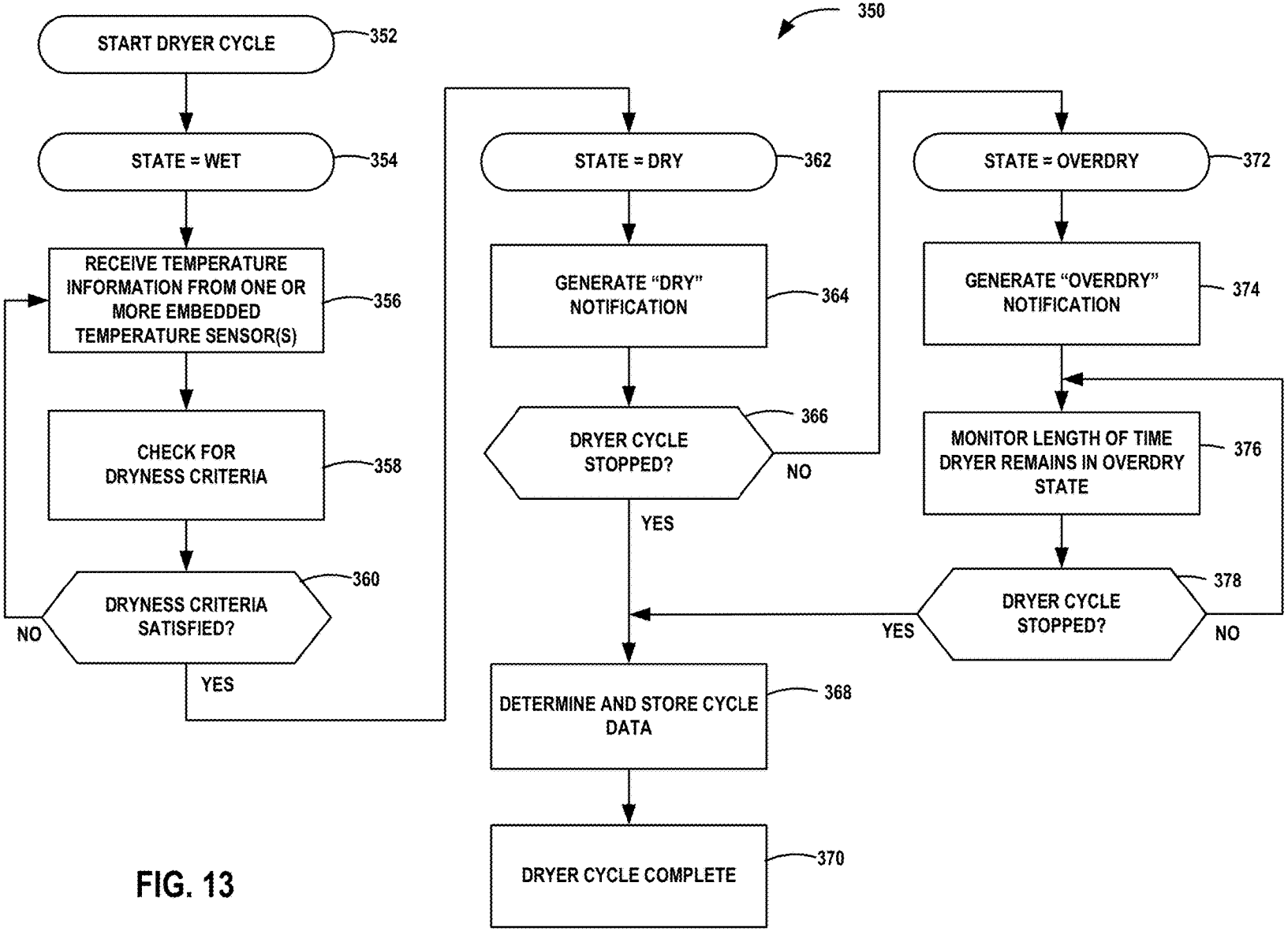
FIG. 13 is a flow chart illustrating an example process by which a computing device may monitor and determine dryness of textiles in a dryer using based on temperature information received from one or more embedded temperature sensors.

FIG. 13 is a flow chart illustrating an example process (350) by which a computing device, such as a user computing device or dryer controller, may monitor and determine dryness of textiles in a dryer using based on temperature information received from one or more embedded temperature sensors, such as embedded temperature sensors 20 and/or 150, in accordance with the present disclosure. The computing device may include, for example, the example user computing device 160 of FIG. 6, the dryer controller 100 of FIGS. 6 and 7, and/or remote computing device 150 of FIG. 7200. The process (350) may be controlled, for example, based on execution of instructions stored in dryer determination module 116 and executed by processors 102 as shown in FIG. 7, and/or execution of instructions stored in dryer monitor module application module 206 and executed by processor(s) 202 as shown in FIG. 6.

At the start of a dryer cycle (352), the dryer enters the so-called "wet" state (354) in which one or more textiles to be dried, each including at least one embedded temperature sensor, are present in the drying compartment of the dryer. The temperature information may be received in real-time, on demand, or both. The computing device receives temperature information from one or more embedded temperature sensors inside the dryer compartment of the dryer (356). The temperature information is indicative of the surface temperature of the associated textile, and may be sampled by the one or more embedded temperature sensor(s) at a specified sampling rate. The computing device analyzes the temperature information received from the one or more embedded temperature sensor(s) with respect to dryness criteria to determine the dryness of the textile (358).

The dryness criteria may include determining whether a predetermined minimum amount of time has elapsed since the start of the dryer cycle, identifying one or more local minima and/or local maxima in the temperature information received from each individual embedded temperature sensor present in the drying compartment of the dryer, determining a slope of the temperature versus time curve, identifying some other characteristic feature of the temperature versus time curve from the embedded temperature sensors, or other dryness criteria. For example, if there are 10 textiles in the drying compartment, each having an associated embedded temperature sensor, the computing device may identify a local minima in the temperature information received from each of the 10 embedded temperature sensors. In another example, the computing device may determine the slope of the temperature versus time curve in the temperature information received from each of the embedded temperature sensors, etc. In other examples, the dryness criteria may also take into account motion information from an inertial measurement unit on the embedded temperature sensor.

The computing devices determines whether the dryness criteria is satisfied (360). If the dryness criteria is not satisfied, the computing device continues to receive temperature information from the one or more embedded temperature sensors (356). When the dryness criteria is satisfied (360), the textiles in the dryer may be determined to be "dry" and the dryer enters the "dry" state (362). For example, the dryness criteria may require that the temperature information received from all of the linen temperature sensors in the dryer compartment achieve a local minimum in order to determine that the load of laundry (that is, the group of textiles being subjected to the dryer cycle) is "dry." As another example, the dryness criteria may require that the temperature information received from at least one of the embedded temperature sensors in the dryer compartment achieve a local minimum (or satisfy a predetermined threshold slope, etc.) in order to identify the dry point. As another example, the dryness criteria may require that the temperature information received from a predefined percentage of the embedded temperature sensors in the dryer compartment achieve a local minimum (or satisfy a predetermined threshold slope, etc.) in order to identify the dry point. As another example, the dryness criteria may require that the average of the temperature information received from all of the embedded temperature sensors achieves a local minimum (or satisfies a predetermined threshold slope, etc.) in order to identify the dry point.

Once in the dry state (362) the computing device may generate a "dry" notification (364). The dry notification may be generated for display on the user computing device and/or on the user interface of a dryer. The dry notification (and/or any other notification) may further be sent to a remotely located or cloud-based computing device. The computing device determines whether the dryer cycle has stopped (366). The dryer cycle may be stopped automatically or manually. If the dryer cycle has been stopped, the computing device determines and stores the dryer cycle data, including the temperature information received from the one or more embedded temperature sensors in the drying compartment of the dryer (368) and the dryer monitor process is complete (370). Other cycle data may include, for example, a dryer cycle number, a machine or dryer id, a time/date stamp, a textile type, a dryer status (wet, dry, overdry), a time to "dry" state, a total dryer run time, an overdry time, one or more graphs or charts, etc.

If, on the other hand, while in the "dry" state the computing device determines that the dryer cycle has not stopped (366), the computing device enters the "overdry" state (372). The overdry state may be entered a predetermined period of time during which the dryer continues to run after entering the dry state. Once in the overdry state (372) the computing device may generate an "overdry" notification (374). The overdry notification may be generated for display on the user computing device and/or on the user interface of a dryer. The computing device monitors the length of the time the dryer remains in the overdry state (376, 378). Once the dryer cycle has stopped (378), the computing device determines and stores the dryer cycle data, including the temperature information received from the one or more embedded temperature sensors in the drying compartment of the dryer (368) and the dryer monitor process is complete (370).

Although the examples presented herein are described generally with respect to automated clothes drying machines, it shall be understood that the cleaning process verification techniques described herein may be applied to a variety of other applications. Such applications may include, for example, food and/or beverage processing equipment, laundry applications, agricultural applications, hospitality applications, and/or any other application in which determination of dryness of an article may be useful. In addition, temperature information obtained from an embedded temperature sensor associated with an article may be used to verify or validate "proof-of-clean" based on analysis of the temperature information.

In one or more examples, the functions described herein may be implemented in hardware, software, firmware, or any combination thereof If implemented in software, the functions may be stored on or transmitted over, as one or more instructions or code, a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol. In this manner, computer-readable media generally may correspond to (1) tangible computer-readable storage media, which is non-transitory or (2) a communication medium such as a signal or carrier wave. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. It should be understood, however, that computer-readable storage media and data storage media do not include connections, carrier waves, signals, or other transient media, but are instead directed to non-transient, tangible storage media. Disk and disc, as used, includes compact disc (CD), laser disc, optical disc, digital versatile disc (DVD), floppy disk and Blu-ray disc, where disks usually reproduce data magnetically, while discs reproduce data optically with lasers.

Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used may refer to any of the foregoing structure or any other structure suitable for implementation of the techniques described. In addition, in some examples, the functionality described may be provided within dedicated hardware and/or software modules. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a hardware unit or provided by a collection of interoperative hardware units, including one or more processors as described above, in conjunction with suitable software and/or firmware.

It is to be recognized that depending on the example, certain acts or events of any of the methods described herein can be performed in a different sequence, may be added, merged, or left out altogether (e.g., not all described acts or events are necessary for the practice of the method). Moreover, in certain examples, acts or events may be performed concurrently, e.g., through multi-threaded processing, interrupt processing, or multiple processors, rather than sequentially.

In some examples, a computer-readable storage medium may include a non-transitory medium. The term "non-transitory" may indicate that the storage medium is not embodied in a carrier wave or a propagated signal. In certain examples, a non-transitory storage medium may store data that can, over time, change (e.g., in RAM or cache).

EXAMPLES

Example 1. A system comprising at least one embedded temperature sensor that senses a temperature of a textile in the drying compartment of a clothes dryer and wirelessly transmits temperature information including the sensed temperature of the textile during a dryer cycle of the clothes dryer; a computing device comprising at least one processor; and a storage device comprising instructions executable by the at least one processor to: receive the temperature information transmitted by the embedded temperature sensor; determine, based on the temperature information, a dryness of the textile at one or more times during the dryer cycle; and generate an indication of the dryness of the textile during the dryer cycle.

Example 2. The system of Example 1, the storage device further comprising instructions executable by the at least one processor to: identify a local minima in temperature versus time data of the temperature of the textile sensed by the embedded temperature sensor at one or more times during the dryer cycle; determine that the textile is dry at a time associated with the identified local minima.

Example 3. The system of 2, wherein the local minima is identified based on a first derivative test.

Example 4. The system of Example 2 wherein the temperature versus time data of the temperature of the textile sensed by the embedded temperature sensor exhibits a characteristic shape including a local maxima occurring subsequent to the start of the dryer cycle and the local minima occurring subsequent to the first local maxima.

Example 5. The system of Example 2 wherein the temperature versus time data of the temperature of the textile sensed by the embedded temperature sensor exhibits a characteristic shape including a temperature increase occurring subsequent to a start of the dryer cycle, a local maxima occurring subsequent to the temperature increase, a temperature decrease occurring subsequent to the local maxima, the local minima occurring subsequent to the first local maxima, and a second temperature increase occurring subsequent to the local minima.

Example 6. The system of Example 1, the storage device further comprising instructions executable by the at least one processor to: determine, based on the temperature information, whether the textile is overdry; and generate, upon determining that the textile is overdry, an indication that the textile is overdry.

Example 7. The system of Example 1, the storage device further comprising instructions executable by the at least one processor to determine, based on the temperature information, that the textile is overdry a predetermined period of time after the textile is determined to be dry.

Example 8. The system of Example 1, the storage device further comprising instructions executable by the at least one processor to automatically control the dryer cycle of the clothes dryer based on the temperature information.

Example 9. The system of Example 1, wherein automatically controlling the dryer cycle of the clothes dryer includes generating a control signal that causes the clothes dryer to stop the dryer cycle of the clothes dryer or initiate a cool-down phase of the dryer cycle.

Example 10. The system of Example 1, wherein the computing device is a dryer controller that automatically controls the dryer cycle of the clothes dryer based on the temperature information received from the embedded temperature sensor.

Example 11. The system of Example 1, wherein the computing device is a user computing device including a user interface having a display, and wherein the storage device further comprises instructions executable by the at least one processor to:

generate, for display on the user interface, a graph of the sensed temperature information versus time received during the dryer cycle of the clothes dryer.

Example 12. The system of Example 1, wherein the computing device is a user computing device including a user interface having a display, and wherein the storage device further comprises instructions executable by the at least one processor to:

generate, for display on the user interface, at least one of a dryer id associated with the clothes dryer, an embedded temperature id associated with the embedded temperature sensor, a textile type, a time/date stamp, a cycle number, and a battery level associated with the embedded temperature sensor.

Example 13. The system of Example 1 wherein the embedded temperature sensor is attached to a surface of the textile and senses a surface temperature of the textile.

Example 14. The system of Example 1, wherein the embedded temperature sensor is adhered to a surface of the article.

Example 15. The system of Example 1 further including one of a flap, tab, pocket, or envelope that is attached to the article and that is sized to receive the embedded temperature sensor in a position to sense the surface temperature of the article.

Example 16. The system of Example 1, wherein the textile forms a pocket sized to receive the embedded temperature sensor in a position to sense the surface temperature of the textile.

Example 17. The system of Example 1, further including a plurality of embedded temperature sensors, each of which senses a temperature of an associated different one of a plurality of textiles in the drying compartment of the clothes dryer and wirelessly transmits temperature information including the sensed temperature of the associated textile during a dryer cycle of the clothes dryer.

Example 18. The system of Example 17, the storage device comprising instructions executable by the at least one processor to: receive the temperature information transmitted by each of the plurality of embedded temperature sensors; determine, at one or more times during the dryer cycle and based on the temperature information received from each of the plurality of embedded temperature sensors, a dryness of a load of laundry including the plurality of textiles present in the dryer compartment.

Example 19. The system of Example 1, wherein previous to sensing temperature of a textile in the drying compartment of a clothes dryer, the embedded temperature sensor senses temperature of the textile during exposure to a cleaning cycle of a cleaning machine.

Example 20. The system of Example 19, wherein the storage device further comprises instructions executable by the at least one processor to: receive the temperature information of the textile during exposure to the cleaning cycle of the cleaning machine transmitted by the embedded temperature sensor; determine, based on the temperature information of the textile during exposure to the cleaning cycle of the cleaning machine, whether the textile was adequately cleaning during the cleaning cycle; and generate an indication of whether the textile was adequately cleaned during the cleaning cycle.

Example 21. The system of Example 19, wherein the embedded temperature sensor further includes an inertial measurement unit that measures motion of the embedded temperature sensor during the cleaning cycle of the cleaning machine and during the dryer cycle of the clothes dryer.

Example 22. The system of Example 1, wherein the embedded temperature sensor further includes at least one of a conductivity sensor or a turbidity sensor.

Example 23. The system of Example 22 wherein previous to sensing temperature of a textile in the drying compartment of a clothes dryer, the embedded temperature sensor senses temperature of the textile during exposure to a cleaning cycle of a cleaning machine and senses a conductivity of water in the cleaning machine during the cleaning cycle, and wherein the storage device further comprises instructions executable by the at least one processor to: receive conductivity information of the water in the cleaning machine during the cleaning cycle transmitted by the embedded temperature sensor; determine, based on the conductivity information, an amount of chemical cleaning product in the water during the cleaning cycle.

Example 24. The system of Example 23 wherein the storage device further comprises instructions executable by the at least one processor to verify whether the textile was adequately cleaned during the cleaning cycle based on the conductivity information.

Example 25. The system of Example 1 wherein the embedded temperature sensor is battery powered.

Example 26. The system of Example 1 wherein the embedded temperature sensor is non-battery powered.

Example 27. The system of Example 1 wherein the embedded temperature sensor is powered by one of a super capacitor, a thermal energy harvester, or a mechanical energy harvester.

Example 28. The system of Example 1 wherein the computing device is a cloud-based computing device located remotely from the clothes dryer.

Example 29. The system of Example 1 wherein the computing device is a local computing device and wherein the system further comprises a cloud-based computing device located remotely from the local computing device and the clothes dryer, and wherein the cloud-based computing device is configured to: receive the temperature information transmitted by each of a plurality of embedded temperature sensors during a plurality of dryer cycles executed by one or more clothes dryers; and generate one or more reports concerning analysis of the temperature information received from one or more of the plurality of embedded temperature sensors; and transmit at least one of the one or more reports to the local computing device.

Example 30. The system of Example 1, the storage device further comprising instructions executable by the at least one processor to determine that the textile is dry at a time subsequent to the start of the dryer cycle when a slope of the temperature versus time data satisfies a predetermined threshold slope.

Example 31. The system of Example 30, wherein the determination that the textile is dry is determined when the time elapsed since the start of the dryer cycle is greater than a predetermined minimum time and the first derivative of the temperature versus time data is greater than a predetermined minimum value.

Example 32. The system of Example 31 wherein the predetermined minimum time is between 10 and 30 minutes, and wherein the predetermined minimum derivative value is between 100 and 200.

Example 33. A system comprising: at least one embedded temperature sensor that senses a temperature of a textile in the cleaning compartment of a cleaning machine and wirelessly transmits temperature information including the sensed temperature of the textile during a cleaning cycle of the cleaning machine; a computing device comprising at least one processor; and a storage device comprising instructions executable by the at least one processor to: receive the temperature information transmitted by the embedded temperature sensor; determine, based on the temperature information, whether the textile was adequately cleaned during the cleaning cycle; and generate an indication of the cleanliness of the textile after completion of the cleaning cycle.

Example 34. The system of Example 33 wherein the embedded temperature sensor further senses a conductivity of water in the cleaning machine during the cleaning cycle, and wherein the storage device further comprises instructions executable by the at least one processor to: receive conductivity information indicative of the conductivity of the water in the cleaning machine during the cleaning cycle transmitted by the embedded temperature sensor; determine, based on the conductivity information, an amount of chemical cleaning product in the water during the cleaning cycle; determine, based on the temperature information and the conductivity information, whether the textile was adequately cleaned during the cleaning cycle; and generate an indication of the cleanliness of the textile after completion of the cleaning cycle.

Example 35. A system comprising a plurality of embedded temperature sensors, each associated with a different one of a plurality of textiles so as to sense a surface temperature of the associated one of the plurality of textiles, wherein each embedded temperature sensor senses the surface temperature of the associated one of the plurality of textiles at one or more times during a dryer cycle of a clothes dryer and wirelessly transmits temperature information including the sensed surface temperatures of the associated textile; a computing device comprising at least one processor; and a storage device comprising instructions executable by the at least one processor to: receive the temperature information transmitted by each of the plurality of embedded temperature sensors; determine, based on the temperature information received from each of the plurality of embedded temperature sensors, a dryness of a load of laundry comprised of the plurality of textiles.

Example 36. The system of Example 35 wherein the storage device further includes instructions executable by the at least one processor to generate an indication of the dryness of the load of laundry.

Example 37. The system of Example 35 wherein the storage device further includes instructions executable by the at least one processor to control operation of the clothes dryer based on the determination of the dryness of the load of laundry.

Example 38. A method comprising receiving, at one or more times during a dryer cycle of a clothes dryer, temperature information from at least one embedded temperature sensor that senses a temperature of a textile present in a dryer compartment of the clothes dryer during the dryer cycle; determining, based on the temperature information, a dryness of the textile at each of the one or more times during the dryer cycle; and generating, based on a determination that the textile is dry at one of the one or more times during the dryer cycle, an indication that the textile was determined to be dry.

Example 39. The method of Example 38 further comprising controlling operation of the dryer cycle of the clothes dryer based on the determination of dryness of the textile at each of the one or more times during the dryer cycle.

Various examples have been described. These and other examples are within the scope of the following claims.

The invention claimed is:

1. A system comprising:

at least one embedded temperature sensor that senses a temperature of a textile in a drying compartment of a clothes dryer and wirelessly transmits temperature information including a sensed temperature of the textile during a dryer cycle of the clothes dryer;

a computing device comprising at least one processor; and a storage device comprising instructions executable by the at least one processor to:

receive the temperature information transmitted by the embedded temperature sensor;

determine, based on the temperature information, a dryness of the textile at one or more times during the dryer cycle; and generate an indication of the dryness of the textile during the dryer cycle.

2. The system of claim 1, the storage device further comprising instructions executable by the at least one processor to:

identify a local minimum in temperature versus time data of the temperature of the textile sensed by the embedded temperature sensor at one or more times during the dryer cycle; and determine that the textile is dry at a time associated with the identified local minimum.

3. The system of claim 2, wherein the local minimum is identified based on a first derivative test.

4. The system of claim 2 wherein the temperature versus time data of the temperature of the textile sensed by the embedded temperature sensor exhibits a characteristic shape including a local maximum occurring subsequent to a start of the dryer cycle and the local minimum occurring subsequent to a first local maximum.

5. The system of claim 2, wherein the temperature versus time data of the temperature of the textile sensed by the embedded temperature sensor exhibits a characteristic shape including a temperature increase occurring subsequent to a start of the dryer cycle, a local maximum occurring subsequent to the temperature increase, a temperature decrease occurring subsequent to the local maximum, the local minimum occurring subsequent to a first local maximum, and a second temperature increase occurring subsequent to the local minimum.

6. The system of claim 1, the storage device further comprising instructions executable by the at least one processor to: determine, based on the temperature information, whether the textile is overdry; and generate, upon determining that the textile is overdry, an indication that the textile is overdry.

7. The system of claim 1, the storage device further comprising instructions executable by the at least one processor to:

determine, based on the temperature information, that the textile is overdry a predetermined period of time after the textile is determined to be dry.

8. The system of claim 1, the storage device further comprising instructions executable by the at least one processor to:

automatically control the dryer cycle of the clothes dryer based on the temperature information.

9. The system of claim 8, wherein automatically controlling the dryer cycle of the clothes dryer includes generating a control signal that causes the clothes dryer to stop the dryer cycle of the clothes dryer or initiate a cool-down phase of the dryer cycle.

10. The system of claim 1, wherein the computing device is a dryer controller that automatically controls the dryer cycle of the clothes dryer based on the temperature information received from the embedded temperature sensor.

11. The system of claim 1, wherein the computing device is a user computing device including a user interface having a display, and wherein the storage device further comprises instructions executable by the at least one processor to:

generate, for display on the user interface, a graph of the sensed temperature information versus time received during the dryer cycle of the clothes dryer.

12. The system of claim 1, wherein the computing device is a user computing device including a user interface having a display, and wherein the storage device further comprises instructions executable by the at least one processor to: generate, for display on the user interface, at least one of a dryer identifier associated with the clothes dryer, an embedded temperature identifier associated with the embedded temperature sensor, a textile type, a time/date stamp, a cycle number, and a battery level associated with the embedded temperature sensor.

13. The system of claim 1 wherein the embedded temperature sensor is attached to a surface of the textile and the sensed temperature is a surface temperature of the textile.

14. The system of claim 1, wherein the embedded temperature sensor is adhered to a surface of the textile.

15. The system of claim 1 further including one of a flap, tab, pocket, or envelope that is attached to the textile and that is sized to receive the embedded temperature sensor in a position to sense the temperature of the textile.

16. The system of claim 1, wherein the textile forms a pocket sized to receive the embedded temperature sensor in a position to sense the temperature of the textile.

17. The system of claim 1, wherein the embedded temperature sensor further includes at least one of a conductivity sensor or a turbidity sensor.

18. The system of claim 1, wherein the embedded temperature sensor is battery powered.

19. The system of claim 1, wherein the embedded temperature sensor is non-battery powered.

20. The system of claim 19 wherein the embedded temperature sensor is powered by one of a super capacitor, a thermal energy harvester, or a mechanical energy harvester.

21. The system of claim 1, wherein the computing device is a cloud-based computing device located remotely from the clothes dryer.

22. The system of claim 1, the storage device further comprising instructions executable by the at least one processor to: determine that the textile is dry at a time subsequent to a start of the dryer cycle when a slope of temperature versus time data satisfies a predetermined threshold slope.

23. The system of claim 22, wherein the determination that the textile is dry is determined when a time elapsed since the start of the dryer cycle is greater than a predetermined minimum time and a first derivative of the temperature versus time data is greater than a predetermined minimum value.

24. The system of claim 23, wherein the predetermined minimum time is between 10 and 30 minutes, and wherein the predetermined minimum value is between 100 and 200.

* * * * *